US007031642B2

(12) United States Patent
Abe

(10) Patent No.: US 7,031,642 B2
(45) Date of Patent: Apr. 18, 2006

(54) DRIVING SYSTEM FOR COLOR IMAGE FORMING APPARATUS

(75) Inventor: Nobumasa Abe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 104 days.

(21) Appl. No.: 10/659,700

(22) Filed: Sep. 11, 2003

(65) Prior Publication Data

US 2004/0223785 A1 Nov. 11, 2004

(30) Foreign Application Priority Data

Sep. 11, 2002 (JP) ..... P2002-265407
Sep. 13, 2002 (JP) ..... P2002-268301
Sep. 19, 2002 (JP) ..... P2002-273320
Sep. 19, 2002 (JP) ..... P2002-273321
Sep. 26, 2002 (JP) ..... P2002-280815

(51) Int. Cl.
*G03G 15/00* (2006.01)

(52) U.S. Cl. ..... 399/167; 399/299

(58) Field of Classification Search ..... 399/179, 399/299, 54, 66, 112, 115, 167, 174, 175, 399/176, 228, 223
See application file for complete search history.

(56) References Cited

U.S. PATENT DOCUMENTS 5,740,493 A * 4/1998 Otaki et al. ..... 399/71
5,812,183 A * 9/1998 Jeran ..... 347/262
6,148,163 A * 11/2000 Ito ..... 399/67
6,269,229 B1 * 7/2001 Yamamoto ..... 399/75
6,836,630 B1 * 12/2004 Owen et al. ..... 399/112

FOREIGN PATENT DOCUMENTS

| | | | |
|---|---|---|---|
| EP | 1267216 A1 | * | 12/2002 |
| JP | 59204860 A | * | 11/1984 |
| JP | 62-299873 A | | 12/1987 |
| JP | 3-288173 A | | 12/1991 |
| JP | 06175424 A | * | 6/1994 |
| JP | 06317969 A | * | 11/1994 |
| JP | 10171331 A | * | 6/1998 |
| JP | 10-282855 A | | 10/1998 |
| JP | 11-84798 A | | 3/1999 |
| JP | 2000-29278 A | | 1/2000 |
| JP | 2000356876 A | * | 12/2000 |

* cited by examiner

*Primary Examiner*—Robert Beatty
(74) *Attorney, Agent, or Firm*—Sughrue Mion, PLLC

(57) ABSTRACT

A plurality of image supporters are each operable to support a toner image of one color to be transferred. The toner images are each developed by a developing roller. A plurality of brush rollers are each brought into contact with an associated one of the image supporters to charge the same. A plurality of transmitters are each operable to transmit a driving force of an associated one of the image supporters or an associated developing roller to an associated one of the brush rollers.

25 Claims, 15 Drawing Sheets

| | COMPARATIVE EXAMPLE 1 | EMBODIMENT 1 | | |
|---|---|---|---|---|
| | PHOTOSENSITIVE MEMBER | PHOTOSENSITIVE MEMBER | STEP-UP GEAR | BRUSH ROLLER |
| OUTER DIAMETER (mm) | 30 | 30 | - | 14 |
| TEETH NUMBER | | | | |
| MODULE: 0.5 | | | | |
| TRANSFER EFFICIENCY: 0.95 | | | | |
| NUMBER OF REVOLUTIONS (rpm) | 99.10 | 99.10 | 239.49 | 419.11 |
| PERIPHERAL VELOCITY (mm/SEC) | 155.67 | 155.67 | - | 307.22 |
| DRIVING TORQUE (N·m) | | | | |
| PHOTOSENSITIVE MEMBER | 0.0245 | 0.0245 | 0.0090 | 0.0049 |
| BRUSH ROLLER | 0 | 0.0230 | 0.0090 | 0.0049 |
| <TOTAL> | 0.0245 | 0.0475 | | |

| NAME OF MEMBER | PHOTOSENSITIVE MEMBER (K) | INTER-MEDIATE SHAFT | BRUSH ROLLER (K) | BRUSH ROLLER (C) | BRUSH ROLLER (M) | BRUSH ROLLER (Y) |
|---|---|---|---|---|---|---|
| OUTER DIAMETER (mm) | 30 | - | 14 | 14 | 14 | 14 |
| TEETH NUMBER<br>MODULE: 0.5<br>TRANSFER EFFICIENCY: 0.95 | | | | | | |
| NUMBER OF REVOLUTIONS (rpm) | 99.10 | 239.49 | 419.11 | 419.11 | 419.11 | 419.11 |
| PERIPHERAL VELOCITY (mm/SEC) | 155.67 | - | 307.22 | 307.22 | 307.22 | 307.22 |
| DRIVING TORQUE (N·m)<br>BRUSH ROLLER (Y) | 0.0230 | 0.0090 | 0.0049 | | | |
| BRUSH ROLLER (M) | 0.0242 | 0.0095 | 0.0052 | 0.0049 | | |
| BRUSH ROLLER (C) | 0.0254 | 0.0100 | 0.0054 | 0.0052 | 0.0049 | |
| BRUSH ROLLER (K) | 0.0268 | 0.0105 | 0.0057 | 0.0054 | 0.0052 | 0.0049 |
| <TOTAL> | 0.0994 | | | | | |

FIG. 9

| NAME OF MEMBER | MOTOR SHAFT | INTER-MEDIATE SHAFT | PHOTO-SENSITIVE MEMBER (Y) | IDLER SHAFT | PHOTO-SENSITIVE MEMBER (M) | IDLER SHAFT | PHOTO-SENSITIVE MEMBER (C) | IDLER SHAFT | PHOTO-SENSITIVE MEMBER (K) |
|---|---|---|---|---|---|---|---|---|---|
| TEETH NUMBER<br>MODULE: 0.8<br>TRANSFER EFFICIENCY: 0.95 | 53a | 54 | 51Y 20Y | 52 | 51M 20M | 52 | 51C 20C | 52 | 51K 20K |
| NUMBER OF REVOLUTIONS (rpm) | 454.68 | 151.56 | 99.10 | 151.56 | 99.10 | 151.56 | 99.10 | 151.56 | 99.10 |
| COMPARATIVE EXAMPLE 2 | | | | | | | | | UNIT: N·m |
| 1ST PHOTOSENSITIVE MEMBER | 0.0059 | 0.0169 | 0.0245 | | | | | | |
| 2ND PHOTOSENSITIVE MEMBER | 0.0066 | 0.0187 | 0.0271 | 0.0169 | 0.0245 | | | | |
| 3RD PHOTOSENSITIVE MEMBER | 0.0073 | 0.0207 | 0.0301 | 0.0187 | 0.0271 | 0.0169 | 0.0245 | | |
| 4TH PHOTOSENSITIVE MEMBER | 0.0080 | 0.0229 | 0.0333 | 0.0207 | 0.0301 | 0.0187 | 0.0271 | 0.0169 | 0.0245 |
| <TOTAL> | 0.0278 | | | | | | | | |
| EMBODIMENT 4<br>DRIVING TORQUE BRUSH ROLLER | 0.0326 | 0.0930 | 0.1352 | 0.0840 | 0.1220 | 0.0758 | 0.1101 | 0.0684 | UNIT: N·m<br>0.0994 |
| 1ST PHOTOSENSITIVE MEMBER | 0.0059 | 0.0169 | 0.0245 | | | | | | |
| 2ND PHOTOSENSITIVE MEMBER | 0.0066 | 0.0187 | 0.0271 | 0.0169 | 0.0245 | | | | |
| 3RD PHOTOSENSITIVE MEMBER | 0.0073 | 0.0207 | 0.0301 | 0.0187 | 0.0271 | 0.0169 | 0.0245 | | |
| 4TH PHOTOSENSITIVE MEMBER | 0.0080 | 0.0229 | 0.0333 | 0.0207 | 0.0301 | 0.0187 | 0.0271 | 0.0169 | 0.0245 |
| <TOTAL> | 0.0604 | | | | | | | | |

DRIVING SYSTEM FOR COLOR IMAGE FORMING APPARATUS

BACKGROUND OF THE INVENTION

The present invention relates to a tandem-type color image forming apparatus which forms a color image by causing a transferring belt to pass through image forming stations for respective colors that are disposed along the transferring belt. In each image forming station, a charging device, an image writing device, and a developing device are disposed around an image carrier.

For example, Japanese Patent Publication No. 11-84798A discloses a tandem-type color image forming apparatus in which a plurality of image forming stations are disposed along the circulating direction of a transferring belt (i.e., sheet transporting belt) and the image carrier of each image forming station is charged uniformly by a brush roller. In contrast to the corona charging which is another typical charging method, the amount of ozone generated by the brush roller charging is very small. The brush roller charging is particularly advantageous in tandem-type color image forming apparatus because each image forming station has a charging device. Although the above publication discloses no brush roller driving method, a method in which driving force is transmitted from an image carrier to a brush roller in a monochrome image forming apparatus is known (e.g., Japanese Patent Publication No. 2000-29278A). Japanese Patent Publication No. 10-282855A discloses a technique in which toner left on an image carrier after the transfer operation is gathered by a brush roller for charging the image carrier uniformly and the toner thus gathered is returned to the image carrier and collected by a developing device while the image forming is not performed.

Recent image forming apparatus have come to employ jumping development in which development is performed in a state that the developing device is not in contact with the image carrier and an image forming method in which the efficiency of transfer from the image carrier to a recording medium (i.e., a sheet or an intermediate transferring belt) is increased by using toner that is manufactured by a polymerization method and is high in sphericity and uniform in particle diameter and a cleaner (rubber blade or the like) for the image carrier is thereby omitted. As a result, the driving load of the image carrier is reduced in those image forming apparatus. In tandem-type image forming apparatus, it has become possible to drive the respective image carriers with a single motor and hence to reduce the size of the entire apparatus.

However, in tandem-type image forming apparatus, the above-mentioned reduction in the driving load of each image carrier causes a problem that periodic density unevenness or color misregistration may occur due to, for example, the synergistic effect of a backlash in the gears of an image carrier driving system and contact/separation operations of a transferring roller and a cleaning blade to/from the transferring belt (i.e., intermediate transferring belt or sheet transporting belt).

Further, in tandem-type image forming apparatus, to reduce the size of each image forming station, it is necessary to make the outer diameter of the brush roller smaller than that of the image carrier. In a configuration in which the image carriers of the respective image forming stations are driven by a single motor as mentioned above and the brush rollers are driven by the same motor as disclosed in Japanese Patent Publication No. 2000-29278A, to rotate the brush rollers at a higher circumferential speed than the image carriers it is necessary to rotate the smaller-diameter brush rollers at a higher rotation speed than the image carriers, which increases the driving load of the motor.

Japanese Patent Publication No. 62-299873A discloses a configuration in which the contact between the sheet transporting belt and the image carrier of each image forming station is maintained even during a monochrome printing operation and image carriers corresponding to colors for which image formation is not necessary are also rotated.

However, stopping the brush rollers for uniformly charging non-image-formation image carriers during formation of a monochrome image causes the following problems:

(1) The hair ends of the brush are much inclined by the rotation of the image carrier at the portion, in contact with the image carrier, of each brush roller being stopped, as a result of which charging unevenness may occur in the image carrier at intervals corresponding to the rotation period of the brush roller in the next image forming operation.

(2) When monochrome images are printed successively, the hair ends of the brush are worn at the portion, in contact with the image carrier, of the brush roller of each of the image forming stations having color toners, as a result of which charging unevenness may occur in the image carrier at intervals corresponding to the rotation period of the brush roller in the next image forming operation.

On the other hand, Japanese Patent Publication No. 3-288173A discloses a technique in which when a monochrome printing operation is performed in a tandem-type image forming apparatus, the sheet transporting belt is separated from the image carriers of the non-image-formation image forming stations having color toners and those image carriers are stopped, to thereby prevent wear of those image carriers due to contact of recording media or sliding contact of a cleaning blade.

In this case, the following problems occur if the brush rollers for uniformly charging respective non-image-formation image carriers are rotated during a monochrome image forming operation:

(1) The rotating brush roller contacts the image carrier being stopped of each of the image forming stations having color toners and wears only the contact portion of the image carrier layer of the image carrier body. When a color image is formed later, image unevenness may occur in the color image at intervals corresponding to the rotation period of the image carriers, which makes it necessary to replace the image carriers before a prescribed number of color images have been printed.

(2) The rotating brush roller contacts the image carrier being stopped of each of the image forming stations having color toners and hence is worn earlier. The brush roller thus worn can no longer give the image carrier a desired amount of charge. It becomes necessary to replace the brush rollers before a prescribed number of color images have been printed.

SUMMARY OF THE INVENTION

It is therefore an object of the invention to provide a color image forming apparatus which is capable of reducing density unevenness and color shift of an obtained image.

It is also an object of the invention to provide a tandem-type color image forming apparatus in which an image carrier is charged by a brush roller, and which is capable of suppressing the load of a motor for driving the image carrier, thereby reducing the entire power loss in the image forming apparatus.

In order to achieve the above objects, according to the invention, there is provided a color image forming apparatus, comprising:

a plurality of image supporters, each of which is operable to support a toner image of one color to be transferred;

a plurality of brush rollers, each of which is brought into contact with an associated one of the image supporters to charge the same; and a plurality of transmitters, each of which is operable to transmit a driving force of an associated one of the image supporters to an associated one of the brush rollers.

Preferably, each of the transmitters comprises a step-up gear.

Preferably, the image supporters and the brush rollers are rotated in an identical direction.

Preferably, the toner image is transferred onto a belt member or a recording medium carried by a belt member.

According to the invention, there is also provided a color image forming apparatus, comprising:

a plurality of image supporters, each of which is operable to support a latent image of one color to be developed;

a plurality of brush rollers, each of which is brought into contact with an associated one of the image supporters to charge the same;

a plurality of developing rollers, each of which is operable to develop the latent image as a toner image of one color which is to be transferred, on an associated one of the image supporters; and a plurality of transmitters, each of which is operable to transmit a driving force of an associated one of the developing rollers to an associated one of the brush rollers.

Preferably, the image supporters and the brush rollers are rotated in an identical direction.

Preferably, the toner image is transferred onto a belt member or a recording medium carried by a belt member.

According to the invention, there is also provided a color image forming apparatus, comprising:

a plurality of image supporters, each of which is operable to support a latent image of one color to be developed;

a plurality of brush rollers, each of which is brought into contact with an associated one of the image supporters to charge the same;

a plurality of developing rollers, each of which is operable to develop the latent image as a toner image of one color which is to be transferred, on an associated one of the image supporters; and a transmitter, operable to transmit a driving force of one of the developing rollers to each of the brush rollers.

Preferably, the image supporters and the brush rollers are rotated in an identical direction.

Preferably, the toner image is transferred onto a belt member or a recording medium carried by a belt member.

According to the invention, there is also provided a color image forming apparatus, comprising:

a plurality of image supporters, each of which is operable to support a toner image of one color to be transferred;

a plurality of brush rollers, each of which is brought into contact with an associated one of the image supporters to charge the same; and a transmitter, operable to transmit a driving force of one of the image supporters to each of the brush rollers.

Preferably, the one of the image supporters is an image supporter which is associated with a black toner image or a yellow toner image.

Preferably, the transmitter comprises a step-up gear.

Preferably, the image supporters and the brush rollers are rotated in an identical direction.

Preferably, the toner image is transferred onto a belt member or a recording medium carried by a belt member.

According to the invention, there is also provided a color image forming apparatus, comprising:

a plurality of image supporters, each of which is operable to support a toner image of one color to be transferred;

a plurality of brush rollers, each of which is brought into contact with an associated one of the image supporters to charge the same; and a driver, operable to rotate every one of the image supporters and every one of the brush rollers in a case where a monochrome image formation is performed.

Preferably, the driver comprises a plurality of transmitters, each of which is operable to transmit a driving force of an associated one of the image supporters to an associated one of the brush rollers.

Here, it is preferable that each of the transmitters comprises a step-up gear.

Alternatively, the driver may comprise a transmitter, operable to transmit a driving force of one of the image supporters associated with a black toner image to each of the brush rollers.

Here, it is preferable that each of the transmitters comprises a step-up gear.

Preferably, the image supporters and the brush rollers are rotated in an identical direction.

Preferably, the toner image is transferred onto a belt member or a recording medium carried by a belt member.

According to the invention, there is also provided a color image forming apparatus, comprising:

a plurality of image supporters, each of which is operable to support a latent image of one color to be developed;

a plurality of brush rollers, each of which is brought into contact with an associated one of the image supporters to charge the same;

a plurality of developing rollers, each of which is operable to develop the latent image as a toner image of one color which is to be transferred, on an associated one of the image supporters; and a driver, operable to stop, in a case where a monochrome image formation is performed, ones of the brush rollers which are associated with ones of the image supporters not used for the monochrome image formation.

Preferably, the driver comprises a plurality of transmitters, each of which is operable to transmit a driving force of an associated one of the image supporters to an associated one of the brush rollers, which are not used for the monochrome image formation.

Here, it is preferable that each of the transmitters comprises a step-up gear.

Alternatively, the driver may comprise a plurality of transmitters, each of which is operable to transmit a driving force of an associated one of the developing rollers to an associated one of the brush rollers, which are not used for the monochrome image formation.

Here, it is preferable that each of the transmitters comprises a step-up gear.

Preferably, the image supporters and the brush rollers are rotated in an identical direction.

Preferably, the toner image is transferred onto a belt member or a recording medium carried by a belt member.

BRIEF DESCRIPTION OF THE DRAWINGS

In the accompanying drawings:

FIG. 9 shows torque acting on the motor shaft in the mechanisms of FIG. 7;

DETAILED DESCRIPTION OF THE INVENTION

Figure 1:
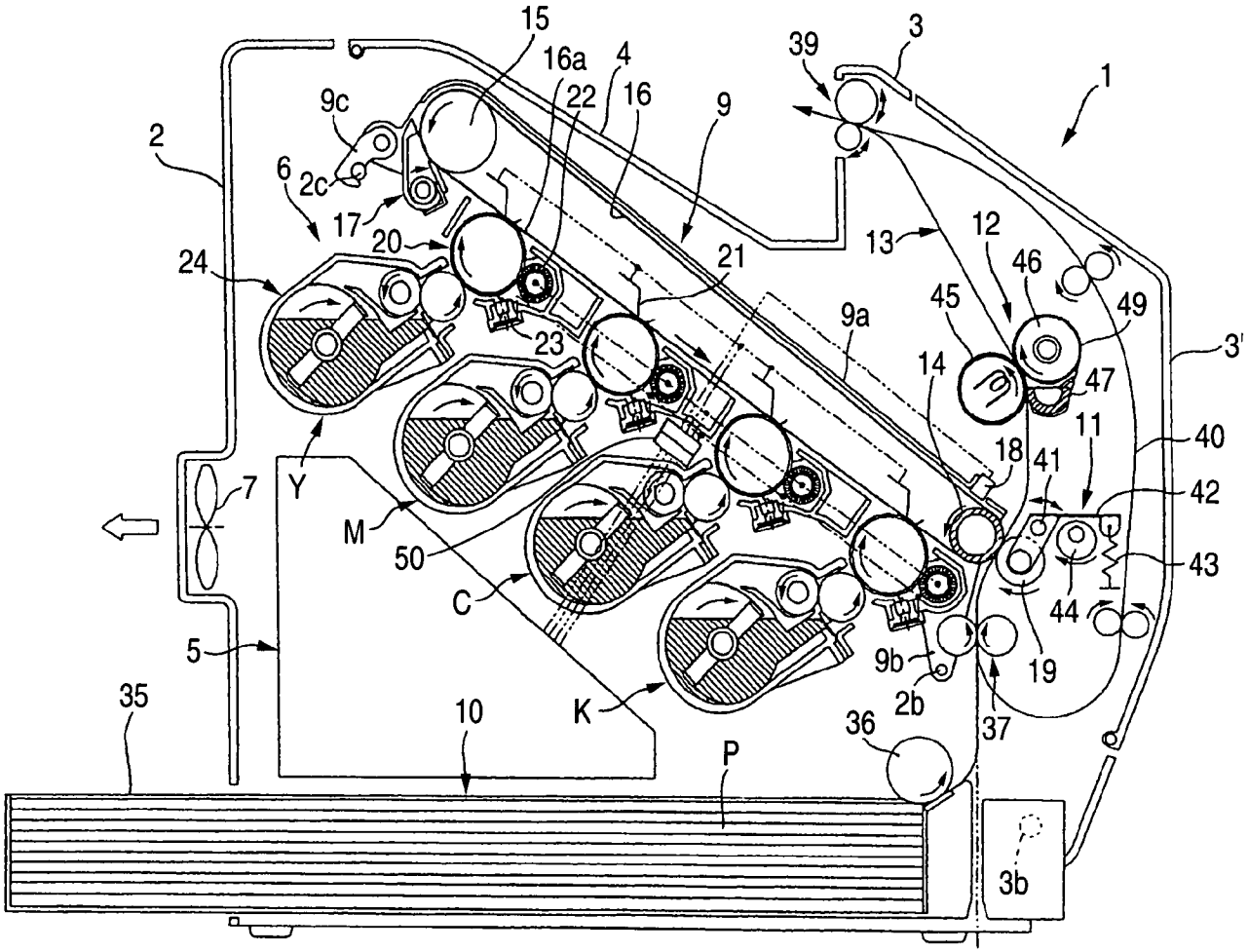
FIG. 1 is a schematic sectional view of a color image forming apparatus according to a first embodiment of the present invention.

Preferred embodiments of the present invention will be described below with reference to the accompanying drawings. The same components are given the same reference symbols in the drawings and descriptions for those components may be omitted in the following description.

An image forming apparatus 1 according to a first embodiment of the invention shown in FIG. 1 has a housing body 2, a first door member 3 that is attached to the front side of the housing body 2 so as to be able to be opened and closed, and a second door member (also serves as a sheet discharging tray) 4 that is attached to the top of the housing body 2 so as to be able to be opened and closed. The first door member 3 is equipped with an door cover 3' that is attached to the front side of the housing body 2 so as to be able to be opened and closed. The door cover 3' can be opened or closed independently or interlocking with the first door member 3.

An electrical components box 5 incorporating a power circuit board and a control circuit board, an image forming unit 6, a fan 7, a transferring belt unit 9, and a sheet feeding unit 10 are provided inside the housing body 2. A secondary transferring unit 11, a fusing unit 12, and a recording medium transporter 13 are provided inside the first door member 3. Expendables such as the image forming unit 6 and the sheet feeding unit 10 are detachable from the housing body 2. Any of those expendables can be repaired or replaced by removing it together with the transferring belt unit 9.

The transferring belt unit 9 is equipped with a driving roller 14 that is disposed at a lower position in the housing body 2 and is rotated by a driving source (not shown), a follower roller 15 that is disposed diagonally above the driving roller 14, an intermediate transferring belt 16 that is stretched between the two rollers 14 and 15 and is driven so as to circulate in the direction indicated by an arrow in FIG. 1, and a cleaner 17 that is brought in contact with the surface of the intermediate transferring belt 16. A portion 16*a* that is transported downward while the intermediate transferring belt 16 is circulated is a tensed portion which is pulled by the driving roller 14.

The driving roller 14 and the follower roller 15 are rotatably supported by a support frame 9*a*. A pivotable portion 9*b*, which is formed at the bottom of the support frame 9*a*, is fitted with a pivot shaft 2*b* that is provided on the housing body 2. In this manner, the support frame 9*a* is pivotably mounted on the housing body 2. A lock lever 9*c*, which is pivotably provided at the top of the support frame 9*a*, can be locked on a lock shaft 2*c* that is provided on the housing body 2.

Figure 2:
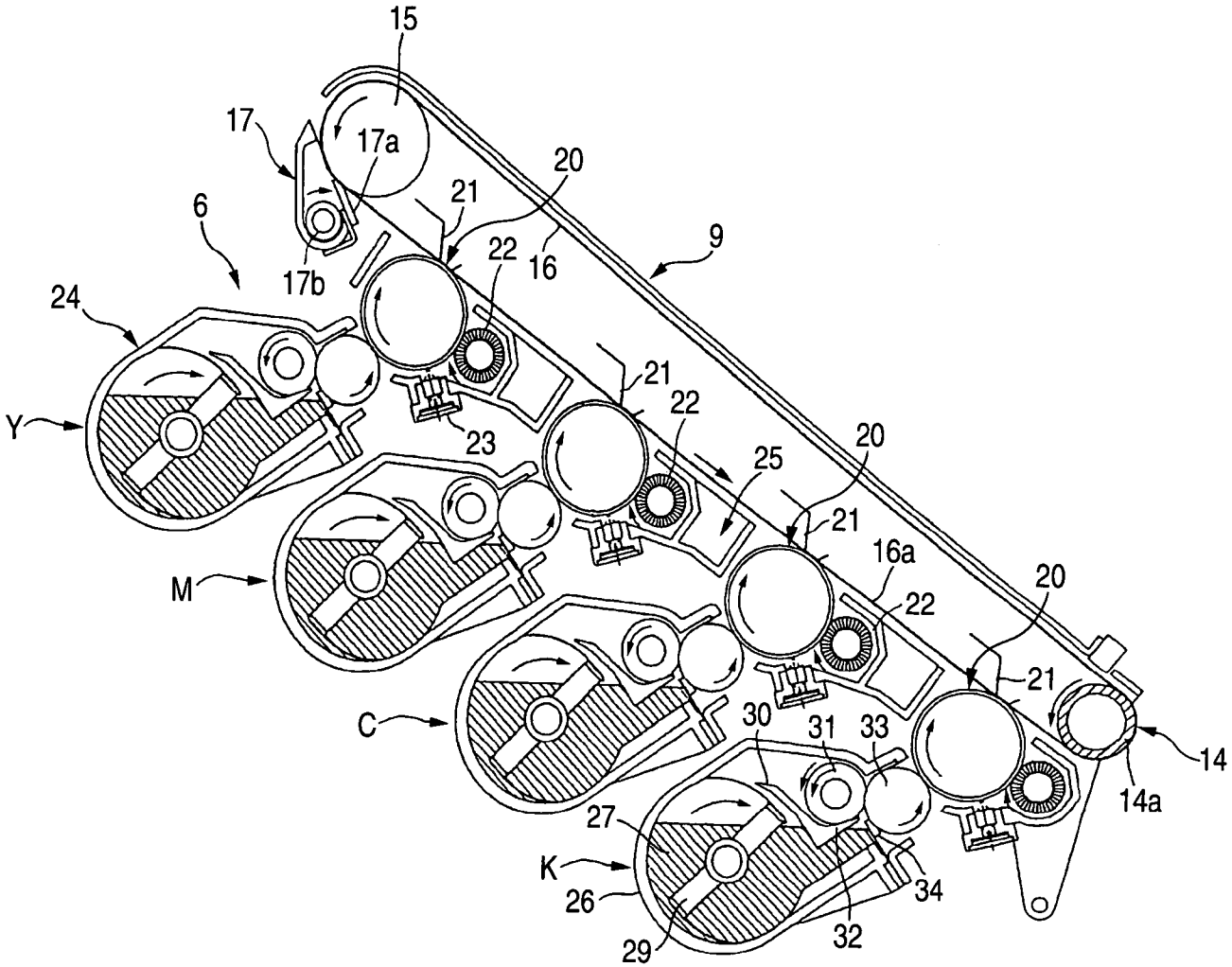
FIG. 2 is an enlarged view of a transferring belt unit and an image forming unit shown in FIG. 1.

The driving roller 14 also serves as a backup roller for a secondary transferring roller 19 that is part of the secondary transferring unit 11. As shown in FIG. 2, a rubber layer 14*a* that is about 3 mm in thickness and $10^5$ Ω·cm or less in volume resistivity is formed on the circumferential surface of the driving roller 14. The rubber layer 14*a* is grounded via a metal shaft, whereby a conductive path for a secondary transfer bias that is supplied via the secondary transferring roller 19 is formed. Forming, on the driving roller 14, the rubber layer 14*a* which produces a high degree of friction and is capable of absorbing impact provides an advantage that impact that is generated when a recording sheet enters the secondary transfer section is less prone to be transmitted to the intermediate transferring belt 16 and hence deterioration in image quality can be avoided.

In this embodiment, the diameter of the driving roller 14 is smaller than that of the follower roller 15, whereby a recording medium as subjected to a secondary transfer can be peeled off easily because of its own elasticity. The follower roller 15 also serves as a backup roller for the cleaner 17.

The cleaner 17 is disposed on the side of the portion 16*a* which is transported downward. As shown in FIG. 2, the cleaner 17 is equipped with a cleaning blade 17*a* for removing toner that remains on the surface of the intermediate transferring belt 16 after a secondary transfer and a toner transport member 17*b* for transporting collected toner. The cleaning blade 17*a* is in contact with the intermediate transferring belt 16 at the position where the intermediate transferring belt 16 leaves the follower roller 15.

Primary transfer members 21 that are leaf spring electrodes are brought, because of its own elasticity, in contact with the back surface of the portion 16*a* of the intermediate transferring belt 16 so as to be opposed to image carriers 20 of image forming stations Y, M, C, and K (described later), respectively. A transfer bias is applied to the primary transfer members 21.

A test pattern sensor 18 is provided on the support frame 9*a* of the transferring belt unit 9 at a position close to the driving roller 14. The test pattern sensor 18 is a sensor that serves to correct color misregistration and the density of each color image by positioning and detecting the density of a toner image of each color on the intermediate transferring belt 16.

The image forming unit 6 is equipped with the image forming stations Y, M, C, and K (for yellow, magenta, cyan, and black, respectively) for forming images of a plurality of (in this embodiment, four) different colors. As shown in detail in FIG. 3, each of the image forming stations Y, M, C, and K has an image carrier 20 that is an image carrier drum and a charging device 22, an image writing device 23, and a developing device 24 that are disposed around the image carrier 20. In FIGS. 1 and 2, reference numerals are drawn only for the charging device 22, the image writing device 23, and the developing device 24 of the image forming station Y because those of the other image forming stations M, C, and K have the same configurations as the former. The arrangement order of the image forming stations Y, M, C, and K is arbitrary.

The image carriers 20 of the respective image forming stations Y, M, C, and K are in contact with the portion 16*a* of the intermediate transferring belt 16 and hence are also arranged in an inclined manner on the left of the driving roller 14 (in FIGS. 1 and 2). The image carriers 20 are rotated in the directions corresponding form to the transporting direction of the intermediate transferring belt 16 as indicated by arrows in FIGS. 1 and 2.

Each charging device 22, which is a conductive brush roller connected to a high-voltage voltage source, is rotated in the same direction as and at a two to three times higher circumferential speed than the associated image carrier 20 while being in contact with it and thereby charges its surface uniformly. The brush roller is formed by spirally winding, on the surface of a highly conductive shaft member (e.g., metal shaft) of 5 to 8 mm in diameter, a fabric that is formed by transplanting (pile weaving) semiconductive fibers of 2 to 6 denier in thickness and $10^7$ to $10^9$ Ω in yarn resistance at a density of 150,000 to 430,000 fibers per square inches. The brush roller is held rotatably in contact with the associated image carrier 20 with a contact depth of 0.3 to 0.5 mm.

Where each image carrier 20 uses a negatively chargeable image carrier, it is desirable that the voltage applied to the brush roller be such that an AC component of 800 to 1,300 V and about 1 kHz is superimposed on a DC component of −300 to −500 V. Where a cleanerless image forming method is employed as in this embodiment, it is desirable that transfer-residual toner that is stuck to the brush roller be emitted toward the image carrier 20 by applying a bias whose polarity is opposite to the toner charging polarity to the brush roller while the image formation is not performed, then transferred to the intermediate transferring belt 16 at the primary transfer section, and finally collected by the cleaner 17 for the intermediate transferring belt 16.

The use of the above charging device 22 makes it possible to charge the surface of each image carrier 20 by a very small current and hence to prevent the inside and the outside of the apparatus from being polluted by ozone unlike in the case of the corona charging method. Further, since soft contact with the image carrier 20 is established, transfer-residual toner that occurs in the case of the roller charging method does not tend to stick to the charging roller or the image carrier 20, whereby stable image quality and high reliability of the apparatus are secured.

Each image writing device 23 is an array-type writing head in which such elements as light-emitting diodes or liquid crystal shutters having a backlight are arrayed in the axial direction of the image carrier 20. Being shorter in optical path length and more compact than the laser scanning optical system, the array-type writing head provides an advantage that it can be disposed in close proximity to the image carrier 20 and the entire apparatus can be made smaller. In this embodiment, the image carrier 20, the charging device 22, and the image writing device 23 of each of the image forming stations Y, M, C, and K are combined into an image carrier unit 25 (see FIG. 2), whereby the array-type writing head is held at a predetermined position. To replace the image carrier unit 25, the image carrier unit 25 including the array-type writing head is removed and a new image carrier unit 25 is used after being subjected to light quantity and position adjustments.

Next, the details of the developing device 24 will be described. In FIG. 2, reference numerals are given to only the components of the developing device 24 of the image forming station K. In this embodiment, the image forming stations Y, M, C, and K are arranged obliquely downward and the image carriers 20 are brought in contact with the downward-transported portion 16*a* of the intermediate transferring belt 16. Therefore, the toner containers 26 are also arranged obliquely downward, which requires each developing device 24 to have a special structure.

Specifically, each developing device 24 is composed of a toner container 26 for storing toner (hatched in FIG. 2; the toner container has a toner storage portion 27), a toner agitator 29 that is disposed inside the toner storage portion 27, a partition member 30 that is disposed at an upper position in the toner storage portion 27, a toner supplying roller 31 that is disposed above the partition member 30, a blade 32 that is provided on the partition member 27 and is in contact with the toner supplying roller 31, a developing roller 33 that is disposed so as to be in contact with the toner supplying roller 31 and the image carrier 20, and a control blade 34 that is in contact with the developing roller 33.

The image carrier 20 is rotated in the direction corresponding to the transporting direction of the portion 16*a*, and the developing roller 33 and the supplying roller 31 in the directions opposite to the rotating direction of the image carrier 20 as indicated by arrows in FIG. 2. On the other hand, the agitator 29 is rotated in the direction opposite to the rotating direction of the supplying roller 31. Toner that has been agitated and carried up by the agitator 29 is supplied to the toner supplying roller 31 across the top surface of the partition member 30 and then slides on the blade 32 with friction. The toner is then supplied to the surface of the developing roller 33 by sticking force that is mechanical sticking force acting on surface asperities of the supplying roller 31 in addition to electrical force generated by frictional electrification. The thickness of the toner supplied to the developing roller 33 is restricted to a prescribed value by the control blade 34, and the thinned toner layer is transported to the image carrier 20. A latent image on the image carrier 20 is developed at a nip section where the developing roller 33 is in contact with the image carrier 20 and its vicinity.

Returning to FIG. 1, the sheet feeding unit 10 is equipped with a sheet feeding cassette 35 where recording media P are stacked and held and a pickup roller 36 for picking up recording media P from the sheet feeding cassette 35 and feeding those one by one.

A registration roller pair 37 for determining the feed timing of a recording sheet P to the secondary transfer section, a secondary transferring unit 11 including a secondary transferring member that is pressed against the driving roller 14 and the intermediate transferring belt 16, a fusing unit 12, a recording medium transporter 13, a sheet discharging roller pair 39, and a transport path 40 for double-sided printing are provided inside the first door member 3.

The secondary transferring unit 11 is equipped with a lever 42 that is pivotally supported by a pivot shaft 41, a secondary transferring roller 19 that is rotatably provided on one end of the lever 42, and a spring 43 that is provided between the other end of the lever 42 and the first door member 3. In an ordinary state, the secondary roller transfer 19 is moved in the direction indicated by an arrow in FIG. 1 being urged by the spring 43 and is thereby pressed against the driving roller 14 and the intermediate transferring belt 16. An eccentric cam 44 is disposed beside the lever 42 and close to the spring 43. The lever 42, the spring 43, and the eccentric cam 44 constitute an actuator for the secondary transferring roller 19. As the eccentric cam 44 is rotated, the lever 42 is rotated against the urging force of the spring 43, whereby the secondary transferring roller 19 is separated from the intermediate transferring belt 16.

The fusing unit 12 has a heating roller 45 that incorporates a heat source such as a halogen heater, a pressure roller 46 that is pressed against the heating roller 45, a belt stretcher 47 that is provided so as to be pivotable about the pressure roller 46, and a heat-resistant belt 49 that is stretched between the pressure roller 46 and the belt stretcher 47. A color image that has been secondarily transferred to a recording medium P is fused thereon at a prescribed temperature at a nip section that is formed by the heating roller 45 and the heat-resistant belt 49. In this embodiment, the fusing unit 12 can be disposed in a space that is diagonally above the intermediate transferring belt 16, that is, a space located on the opposite side of the intermediate transferring belt 16 to the image forming units 6. As a result, the degree of heat transmission to the electrical components box 5, the image forming units 6, and the intermediate transferring belt 16 can be reduced and hence the frequency of color misregistration correcting operations for the individual colors can be reduced.

In the image forming apparatus according to this embodiment, as shown in FIG. 1, the intermediate transferring belt 16 and the image forming stations Y, M, C, and K are oriented or arranged obliquely in the housing body 2 and the electrical components box 5 is disposed right under the image forming stations Y, M, C, and K. Wiring (indicated by two-dot chain lines in FIG. 1) from electrical circuits such as a power circuit, a driving circuit, and a control circuit in the electrical components box 5 is detachably connected to the primary transfer members 21, the charging device 22, the image writing device 23, and the test pattern sensor 18 via a connector 50. The wiring may also be connected to the secondary transferring unit 11, the fusing unit 12, etc. in the first door member 3 via the connector 50 or by causing the wiring to go by a pivot shaft 3*b* of the first door member 3.

The operation of the entire image forming apparatus having the above configuration will be outlined below.

(1) When a print instruction signal (i.e., image formation signal) is input to the control circuit in the electrical components box 5 from a host computer (e.g., personal computer; not shown), the rollers of the image carrier 20 and the developing device 24 of each of the image forming stations Y, M, C, and K start to be rotated.

(2) The surface of each image carrier 20 is charged uniformly by the charging device 22.

(3) In each of the image forming stations Y, M, C, and K, the image writing device 23 performs selective exposure on the uniformly charged surface of the image carrier 20 in accordance with image information of the corresponding color, whereby an electrostatic latent image of the corresponding color is formed.

(4) The electrostatic latent image formed on each image carrier 20 is developed into a toner image by the developing device 24.

(5) The primary transfer voltage whose polarity is opposite to the toner charging polarity is applied to the primary transfer members 21 for the intermediate transferring belt 16, and the toner images formed on the respective image carriers 20 are sequentially transferred to the intermediate transferring belt 16 in a superimposed manner at the respective primary transfer sections as the intermediate transferring belt 16 moves.

(6) In synchronism with the movement of the intermediate transferring belt 16 on which a primary image has been formed by the primary transfers, a recording medium P is fed from the sheet fed cassette 35 to the secondary transferring roller 19 via the registration roller pair 37.

(7) The primary transfer image encounters the recording medium P at the secondary transfer section. Supplied with a bias that is opposite in polarity to the primary transfer voltage via the secondary transferring roller 19 that is pressed against the driving roller 14 for the intermediate transferring belt 16 by the pressing mechanism, the primary transfer image formed on the intermediate transferring belt 16 is transferred secondarily to the recording medium P that has been fed in a synchronized manner.

(8) Residual toner of the secondary transfer is transported toward the follower roller 15 and scraped off by the cleaner 17 which is opposed to the follower roller 15. The intermediate transferring belt 16 is thus refreshed to enable repetition of the above-described cycle.

(9) The toner image on the recording medium P is fused as the recording medium P passes through the fusing unit 12. Then, the recording medium P is transported toward a prescribed position (i.e., toward the sheet discharging tray 4 in the case of single-sided printing and toward the transport path 40 in the case of double-sided printing).

Figure 3:
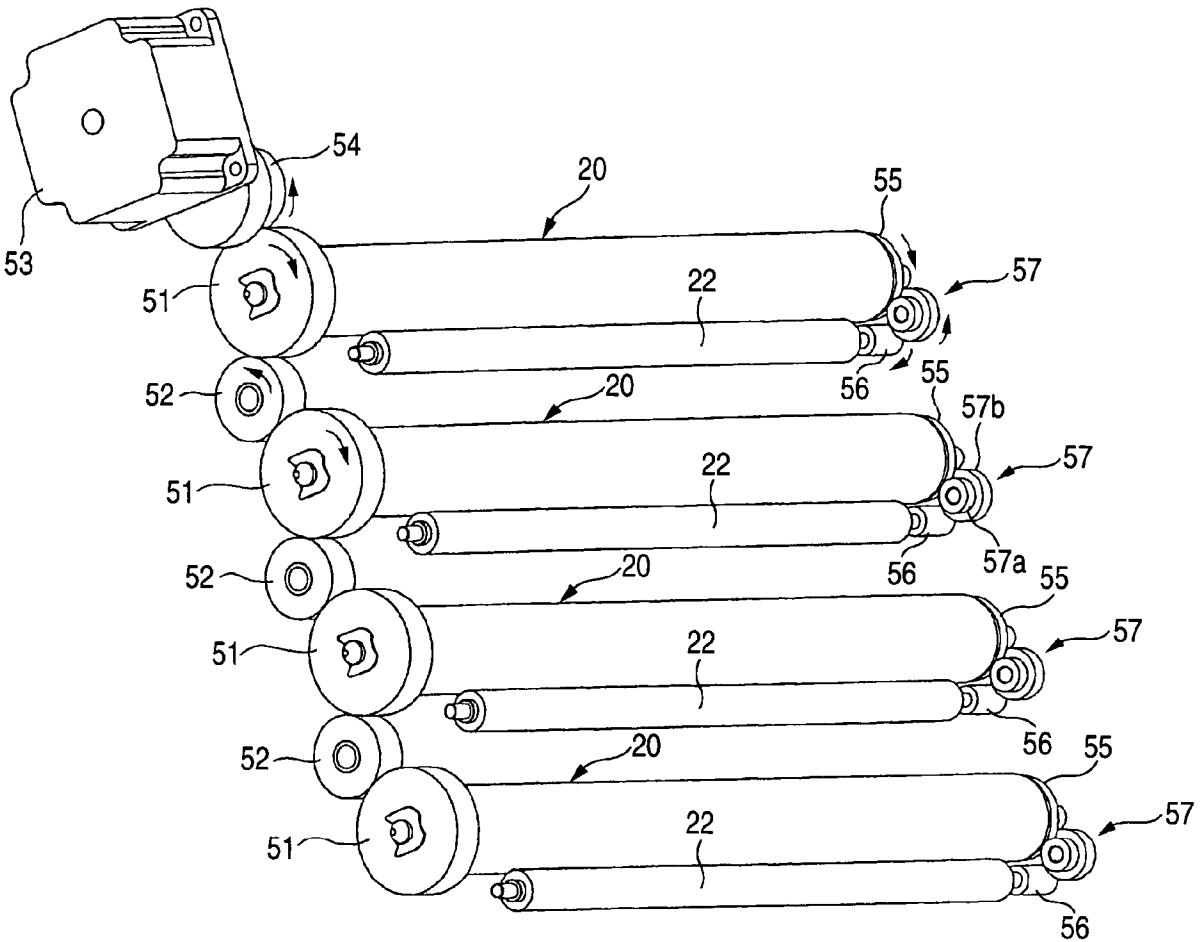
FIG. 3 is a perspective view of a driving system for image carriers and a charging device shown in FIG. 2.

As shown in FIG. 3, a driving gear 51 for the image carrier 20 is connected to one end of each image carrier 20. A relay gear 52 is disposed between any adjacent driving gears 51 to mesh therewith. A driving motor 53 is disposed in close proximity to the image carrier 20 of the image forming station Y which is closest to the follower roller 15 (see FIG. 2) and is in mesh with the driving gear 51 for that image carrier 20 via an output gear 54.

A driving gear 55 is connected to the other end of each image carrier 20 and a follower gear 56 is connected to the other end of each charging device (i.e., brush roller) 22. A speed-increasing gear 57 is in mesh with the driving gear 55 and the follower gear 56. The speed-increasing gear 57 is a two-stage gear having a small-diameter portion 57*a* and a large-diameter portion 57*b* that are in mesh with the driving gear 55 and the follower gear 56, respectively.

In the above mechanism, the single driving motor 53 drives the image carriers 20 sequentially via the output gear 54, the driving gears 51, and the relay gears 52 that are arranged in line and also drives the charging device 22 via the driving gears 55, the speed-increasing gears 57, and the follower gears 56.

Figure 4:
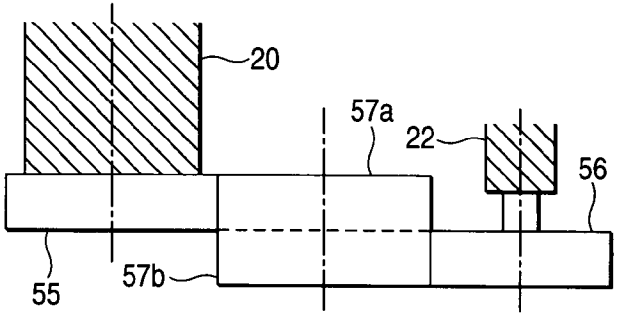
FIG. 4 illustrates a driving load of each image carrier in the mechanism of FIG. 3.

FIG. 4 illustrates a difference in the image carrier driving load (i.e., driving torque) between a case (comparative example 1) in which only the image carrier 20 is rotated in each image forming station and a case (first embodiment) in which the image carrier 20 drives the brush roller 22 (the brush roller 22 is rotated in the same rotating direction as the image carrier 20 at an about two times higher circumferential speed than the image carrier 20).

It is seen that the speed-increasing driving of the brush roller 22 by the image carrier 20 increases the image carrier driving torque by a factor of a little less than two. As a result, the degrees of density unevenness and color misregistration in an image due to the synergistic effect of a backlash in the gears of the image carrier driving system and contact/separation operations of the secondary transferring roller 19 and the cleaning blade 17*a* to/from the transferring belt 16 can be reduced.

In this embodiment, the image carrier 20 and the brush roller 22 of each pair are rotated at different circumferential speeds and the frictional force and the electrostatic attraction force of the brush roller 22 on the image carrier 20 are exerted in such directions as to cancel out a backlash in the gears constituting the image carrier driving system. Therefore, density unevenness and color misregistration in an image can be eliminated more effectively.

Further, since the image carrier 20 and the brush roller 22 of each pair are rotated in the same direction, the frictional force and the electrostatic attraction force of the brush roller 22 on the image carrier 20 are exerted more effectively in such directions as to cancel out a backlash in the gears constituting the image carrier driving system.

Figure 5:
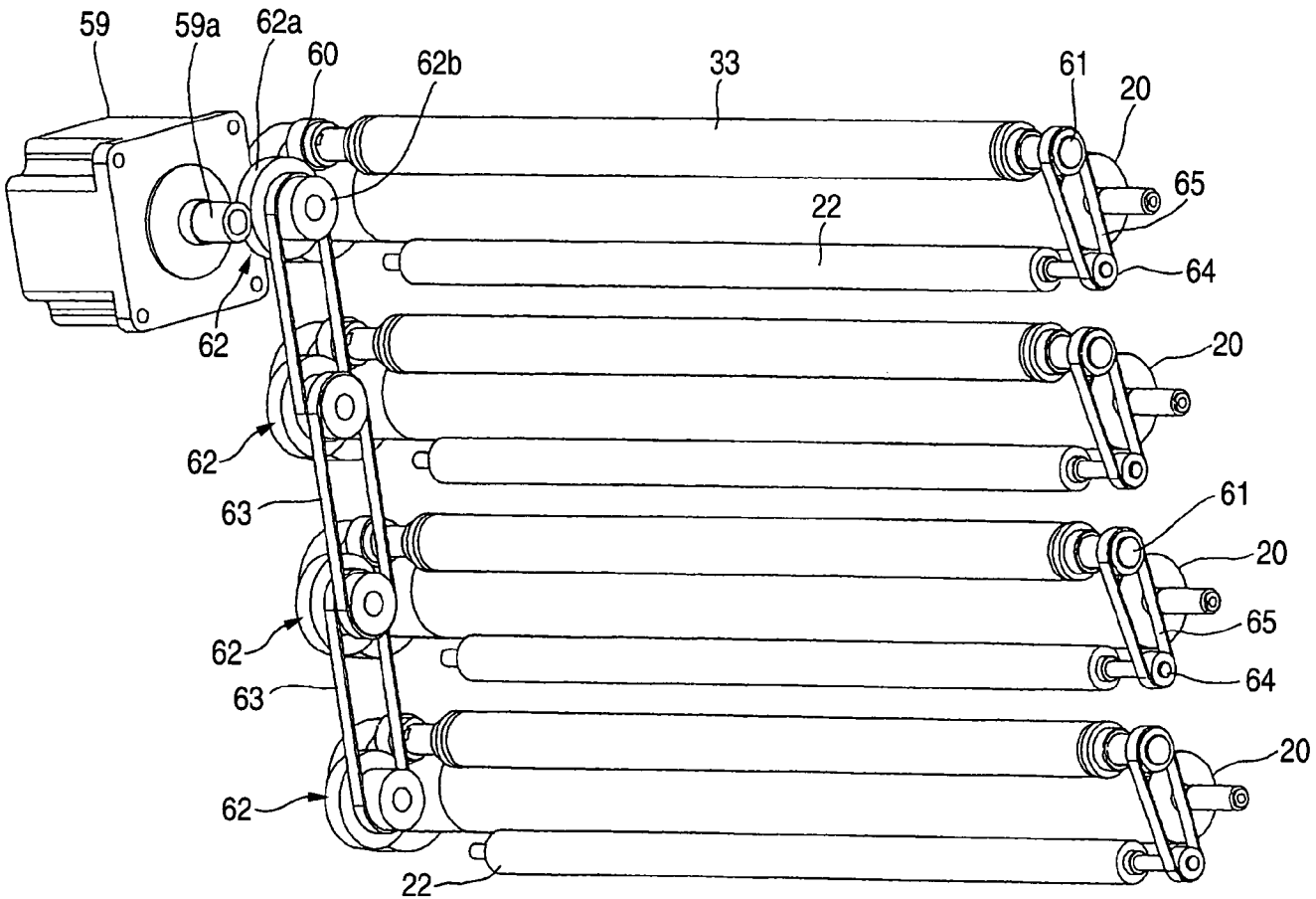
FIG. 5 is a perspective view of a driving system for image carriers and a charging device according to a second embodiment of the invention.

In a second embodiment of the invention shown in FIG. 5, the developing rollers 33 and the brush rollers 22 of the respective image forming stations Y, M, C, and K are driven by a driving motor 59 that is different from the driving motor 53 for the image carriers 20 that was described in the first embodiment. The driving system for the image carriers 20 is not shown in FIG. 5 because it is the same as in the first embodiment.

A driving gear 60 is connected to one end of each developing roller 33 and a driving pulley 61 is connected to the other end. Each driving gear 60 is in mesh with a speed-reducing gear 62*a* that is part of a transmission member 62, and a belt 63 is stretched between pulley portions 62*b* of adjoining transmission members 62. The driving motor 59 is disposed in close proximity to the speed-reducing gear 62*a* of the image forming station Y which is closest to the follower roller 15 (see FIG. 2), and an output shaft 58*a* of the driving motor 59 is in mesh with that speed-reducing gear 62*a*.

A follower pulley 64 is connected to the other end of each charging device (brush roller) 22, and a belt 65 is stretched between the driving pulley 61 and the follower pulley 64.

In the above mechanism, the image carriers 20 of Y, M, C, and K are driven sequentially by the single driving motor 53 via the gear train, the developing rollers 33 are driven by the other driving motor 59, and the brush rollers 22 are driven through the driving of the developing rollers 33.

To reduce the size of the image forming stations 6, it is necessary to make the outer diameters of the developing rollers 33 and the brush rollers 22 smaller than the outer diameter of the image carriers 20. For example, the outer diameters of the developing rollers 33 and the brush rollers 22 are set to similar values of 12 to 18 mm (in this embodiment, 14 mm) for the image carriers 20 whose outer diameter is 30 mm, so that the developing rollers 33 and the brush rollers 22 are driven at circumferential speeds that are relatively close to the circumferential speed of the image carriers 20 (brush rollers 22: two to three times the circumferential speed of the image carriers 2; developing rollers 33: 1.5 to 2.5 times that).

In this embodiment, the driving torque of each brush roller 22 (0.005 to 0.01 N·m) is much smaller than that of each developing roller 33 (0.3 to 0.7 N·m) and hence increase in the load of the motor 59 for driving the developing rollers 33 is small, and the load of the motor 53 for driving the image carriers 20 is not increased. The motive power loss in the entire image forming apparatus can thus be reduced.

Although in the above embodiment the driving motor 59 drives the developing rollers 33 and the brush rollers 22 follow the developing rollers 33, an opposite mechanism is possible in which the driving motor 59 drives the brush rollers 22 and the developing rollers 33 follow the brush rollers 22. Although in the above embodiment the driving force transmission between adjoining ones of the developing rollers 33 and between associated ones of the developing rollers 33 and the brush rollers 22 is performed by a belt, it may be performed by a gear train.

Figure 6:
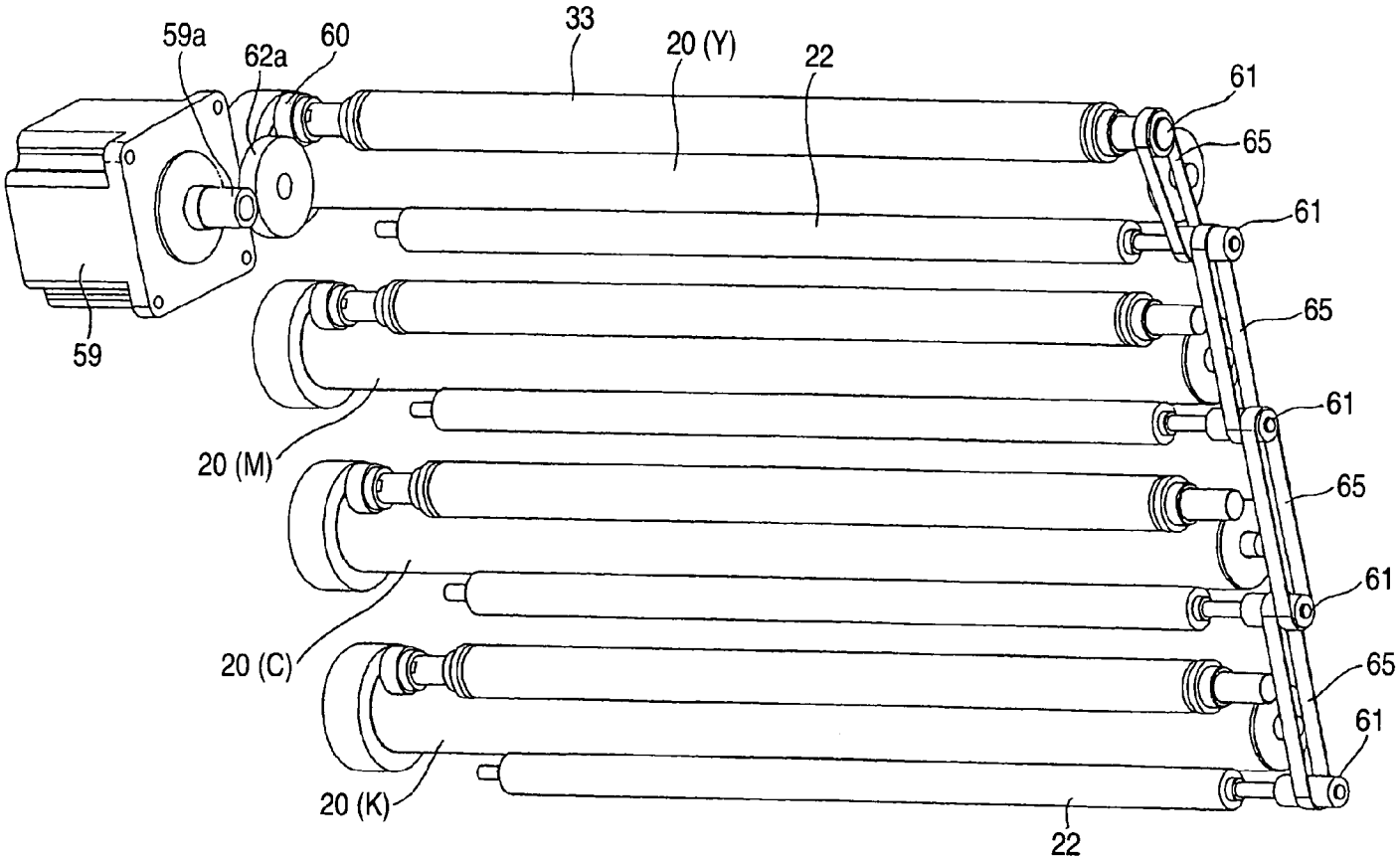
FIG. 6 is a perspective view of a driving system for image carriers and a charging device according to a third embodiment of the invention.

In a third embodiment of the invention shown in FIG. 6, a driving motor 59 is provided that is different from the driving motor 53 (not shown; described in the first embodiment) for the image carriers 20 and a belt 65 is stretched between adjoining ones of driving pulleys 61 that are connected to the ends, on the side opposite to the driving motor 59, of the developing roller 33 of the image forming station Y and the brush rollers 22, respectively. The developing roller 33 of the image forming station Y is driven by the driving motor 59 and the brush rollers 22 are driven by transmitting driving force thereto from that developing roller 33 via the belts 65. The developing rollers 33 of the image forming stations M, C, K are driven by another motor. The driving systems for the image carriers 20 and the developing rollers 33 of the image forming stations M, C, K are not shown in FIG. 6.

Also in this embodiment, the driving torque of the brush rollers 22 as an additional load of the driving motor 59 for driving the developing roller 33 of the image forming station Y is small and hence increase in the load of the motor 59 is small, and the load of the motor 53 for driving the image carriers 20 is not increased. The motive power loss in the entire image forming apparatus can thus be reduced.

Since the driving system for driving the developing roller 33 of the image forming station Y drives the brush rollers 22, rotation-induced vibrations of the brush rollers 22 of the image forming stations Y, M, C, and K shake the developing roller 33 of the image forming station Y. However, resulting deterioration in image quality is negligible because image defects produced by the image forming station Y (yellow) are relatively hard to recognize visually and hence their allowable range is wide.

Since rotation-induced vibrations (very minute vibrations) of the brush rollers 22 are not directly transmitted to the developing rollers 33 of the image forming stations Y, M, C, and K, respectively, the image quality can be increased in each of the image forming stations Y, M, C, and K.

Although in the above embodiment the driving motor 59 drives the developing roller 33 of the image forming station Y and driving force is transmitted from the brush roller 22 of the image forming station Y to the brush rollers 22 of the image forming stations M, C, and K via the belts 65, another mechanism is possible in which the driving motor 59 drives the brush roller 22 of the image forming station Y and the developing roller 33 of the image forming station Y follows the brush roller 22 of the image forming station Y. Separate driving systems that branch off from the driving motor 59 may be provided for the developing roller 33 of the image forming station Y and the brush rollers 22. Although in the above embodiment the driving force transmission between the brush rollers 22 is performed by a belt, it may be performed by a gear train.

Figure 7:
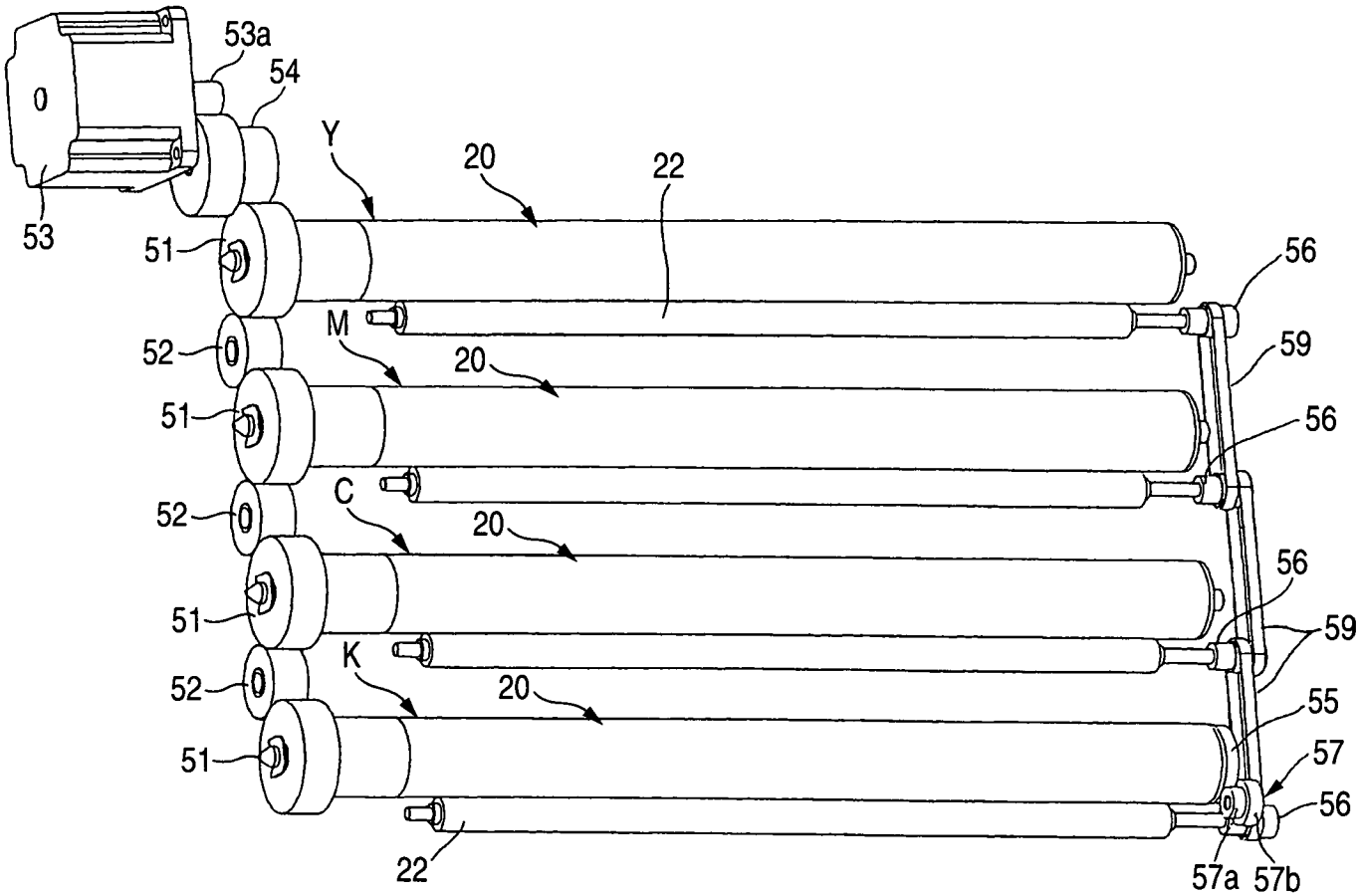
FIG. 7 is a perspective view of a driving system for image carriers and a charging device according to a fourth embodiment of the invention.

In a fourth embodiment according to the invention shown in FIG. 7, an image carrier driving gear 51 is connected to one end of each image carrier 20 and a relay gear 52 is in mesh with the adjacent driving gears 51. A driving motor 53 is disposed in close proximity to the image carrier 20 of the image forming station Y which is closest to the follower roller 15 (see FIG. 2) and an output shaft 53*a* of the driving motor 53 is in mesh with the driving gear 51 for that image carrier 20 via a speed-reducing gear 54.

A driving gear 55 is connected to the other end of the image carrier 20 of the image forming station K which is closest to the driving roller 14 and a follower gear 56 is connected to the other end of the charging device (i.e., brush roller) 22 of the image forming station K. A speed-increasing gear 57 is in mesh with the driving gear 55 and the follower gear 56 of the image forming station K. The speed-increasing gear 57 is a two-stage gear having a small-diameter portion 57*a* and a large-diameter portion 57*b* that are in mesh with the driving gear 55 and the follower gear 56, respectively. Timing belts 59 are stretched between gears 56 of the respective brush rollers 22.

In the above mechanism, the single driving motor 53 sequentially drives the image carriers 20 of the image forming stations Y, M, C, and K via the speed-reducing gear 54, the image carrier driving gears 51, and the relay gears 52 that are arranged in line. Further, the gear train for performing speed-increasing driving on the brush roller 22 of the image forming station K (black) is provided on the side opposite, in the axial direction, to the gear train for driving the image carrier 20 of the image forming station K, and the brush rollers 22 of the image forming stations C, M and, Y are driven by transmitting the driving force of the brush roller 22 of the image forming station K thereto by the timing belts 59.

Figure 8:
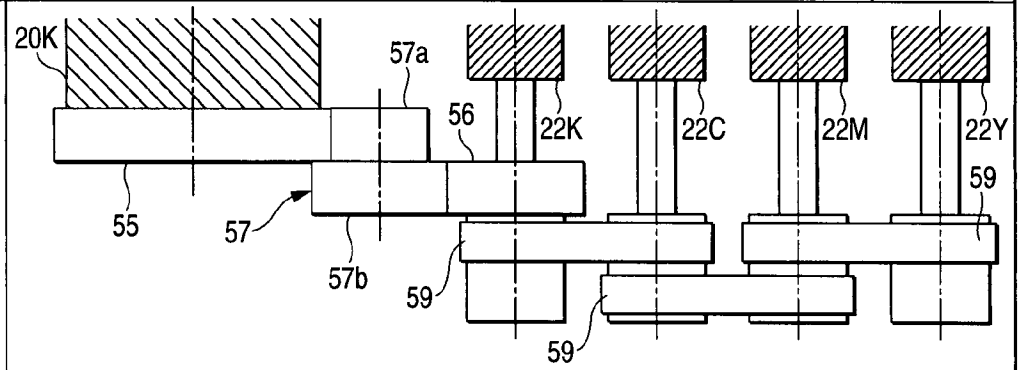
FIG. 8 illustrates a driving load of an image carrier in the mechanism of FIG. 7.

FIG. 8 shows a result of a calculation as to the extent to which the driving loads of the respective brush rollers 22 influence the image carrier 20 of the image forming station K. When the numbers of teeth of the driving gear 55, the speed-increasing gear 57, and the follower gear 56 for the image carrier 20 of the image forming station K are set as shown in FIG. 8 and the rotation speed of the image carrier 20 is set to 99.10 rpm, the driving torque of the image carrier 20 of the image forming station K that is necessary to drive the brush rollers 22 amounts to 0.0994 N·m.

FIG. 9 shows results of calculations of torque acting on the motor shaft in this embodiment and a comparative example 2. The comparative example 2 is different from this embodiment shown in FIG. 7 in that the brush rollers 22 are not driven. It is seen that when the numbers of teeth of the output shaft 53*a*, the speed-decreasing gear 54, the driving gears 51, and the relay gears 52 are set as shown in FIG. 9 and the rotation speed of the image carriers 20 is set to 99.10 rpm, the torque of the motor shaft in this embodiment is more than two times that in the comparative example 2. As a result, the degrees of density unevenness and color misregistration in an image due to the synergistic effect of a backlash in the gears of the image carrier driving system and contact/separation operations of the secondary transferring roller 19 and the cleaning blade 17*a* to/from the transferring belt 16 can be reduced. In this embodiment, the driving torque can be increased for all the image carriers 20 and hence the degrees of density unevenness and color misregistration can be reduced for all the colors.

In this embodiment, the image carrier 20 and the brush roller 22 of each pair are rotated at different circumferential speeds and the frictional force and the electrostatic attraction force of the brush roller 22 on the image carrier 20 are exerted in such directions as to cancel out a backlash in the gears constituting the image carrier driving system. Therefore, density unevenness and color misregistration in an image can be eliminated more effectively.

Further, since the image carrier 20 and the brush roller 22 of each pair are rotated in the same direction, the frictional force and the electrostatic attraction force of the brush roller 22 on the image carrier 20 are exerted more effectively in such directions as to cancel out a backlash in the gears constituting the image carrier driving system.

In particular, in this embodiment, the image carriers 20 of the image forming stations Y, M, C, and K are not separated from the intermediate transferring belt 16 during a monochrome printing operation, whereby the apparatus is reduced in size and simplified in configuration. Therefore, during a monochrome printing operation, to prevent wear of the image carrier layers of the image carriers 20 of the image forming stations Y, M, and C due to their sliding contact with the transferring belt 16, it is necessary to also rotate those image carriers 20. This causes no problems in this embodiment.

Further, during a monochrome printing operation that occurs at a high frequency, the brush rollers 22 that are in contact with the image carriers 20 of the image forming stations Y, M, and C are also rotated. This prevents a phenomenon that the brush would be deformed (inclined) at the portion of each brush roller 22 that is in contact with the image carrier 20 if the brush roller 22 were stopped. No mechanisms for separating the brush rollers 22 from the respective image carriers 20 are needed.

Figure 10:
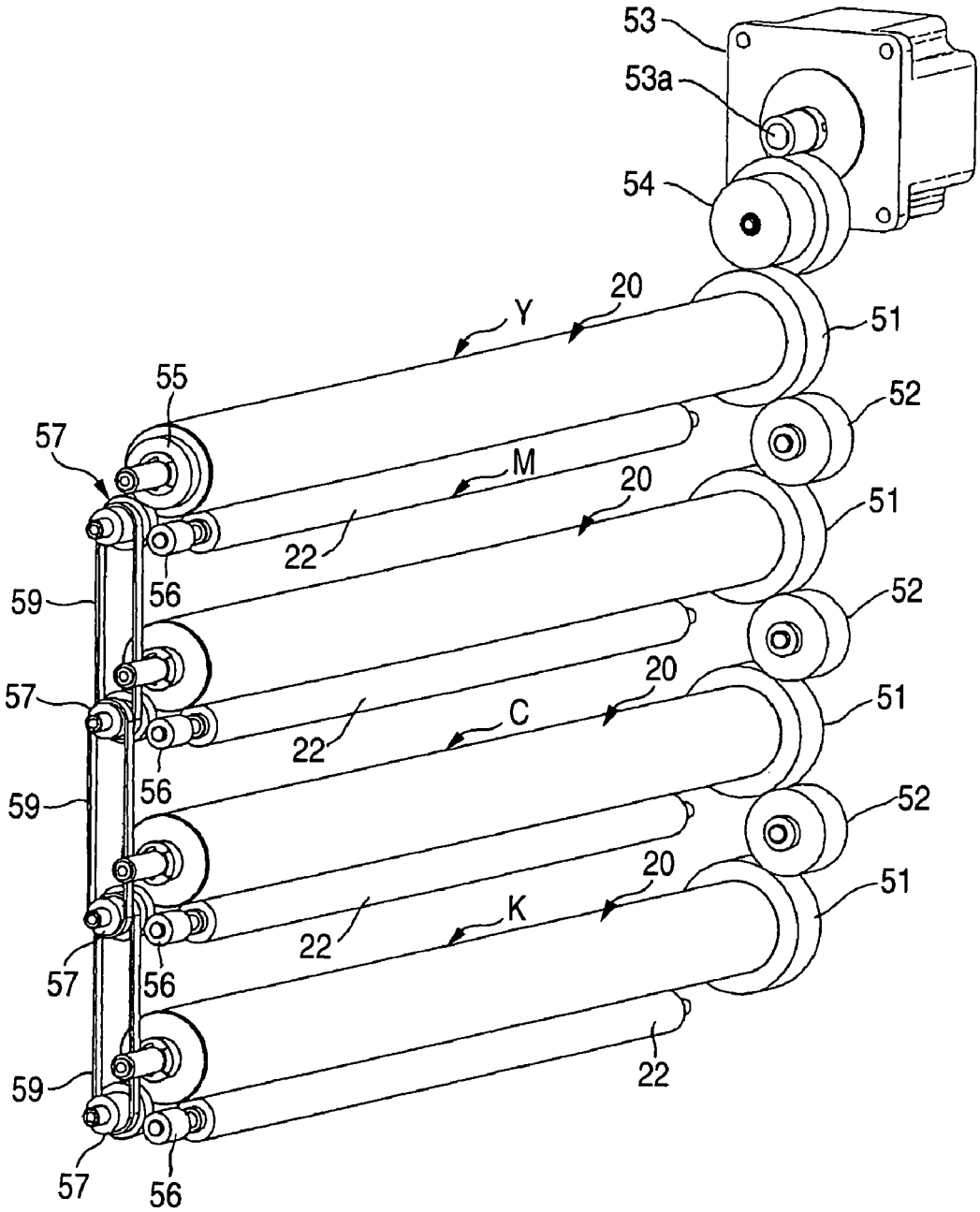
FIG. 10 is a perspective view of a driving system for image carriers and a charging device according to a fifth embodiment of the invention.

In a fifth embodiment of the invention shown in FIG. 10, the driving motor 53 sequentially drives the image carriers 20 of the image forming stations Y, M, C, and K gears 54, 51, and 52. Further, gears 55, 57, and 56 for performing speed-increasing driving on the brush rollers 22 of the image forming stations Y, M, C, and K are provided on the side opposite, in the axial direction, to the above gears 54, 51, and 52 for the image forming stations Y, M, C, K. Reference numeral 59 denotes belts.

In this embodiment, the brush roller 22 of the image forming station Y (yellow) is driven by the driving force of the image carrier 20 of the image forming station Y and the same driving force is used to drive the brush rollers 22 of the other image forming stations M, C, and K. Therefore, rotation-induced vibrations (very small vibrations) of the brush rollers 22 of the image forming stations M, C, and K are not directly transmitted to the image carriers 20 of the image forming stations M, C, and K, respectively, and hence the image quality can be increased in each of the image forming stations M, C, and K.

On the other hand, rotation-induced vibrations of the brush rollers 22 of the image forming stations M, C, and K shake the image carrier 20 of the image forming station Y. However, image quality deterioration of the entire image is low because resulting yellow image defects are relatively hard to recognize visually and hence their allowable range is wide.

Figure 11:
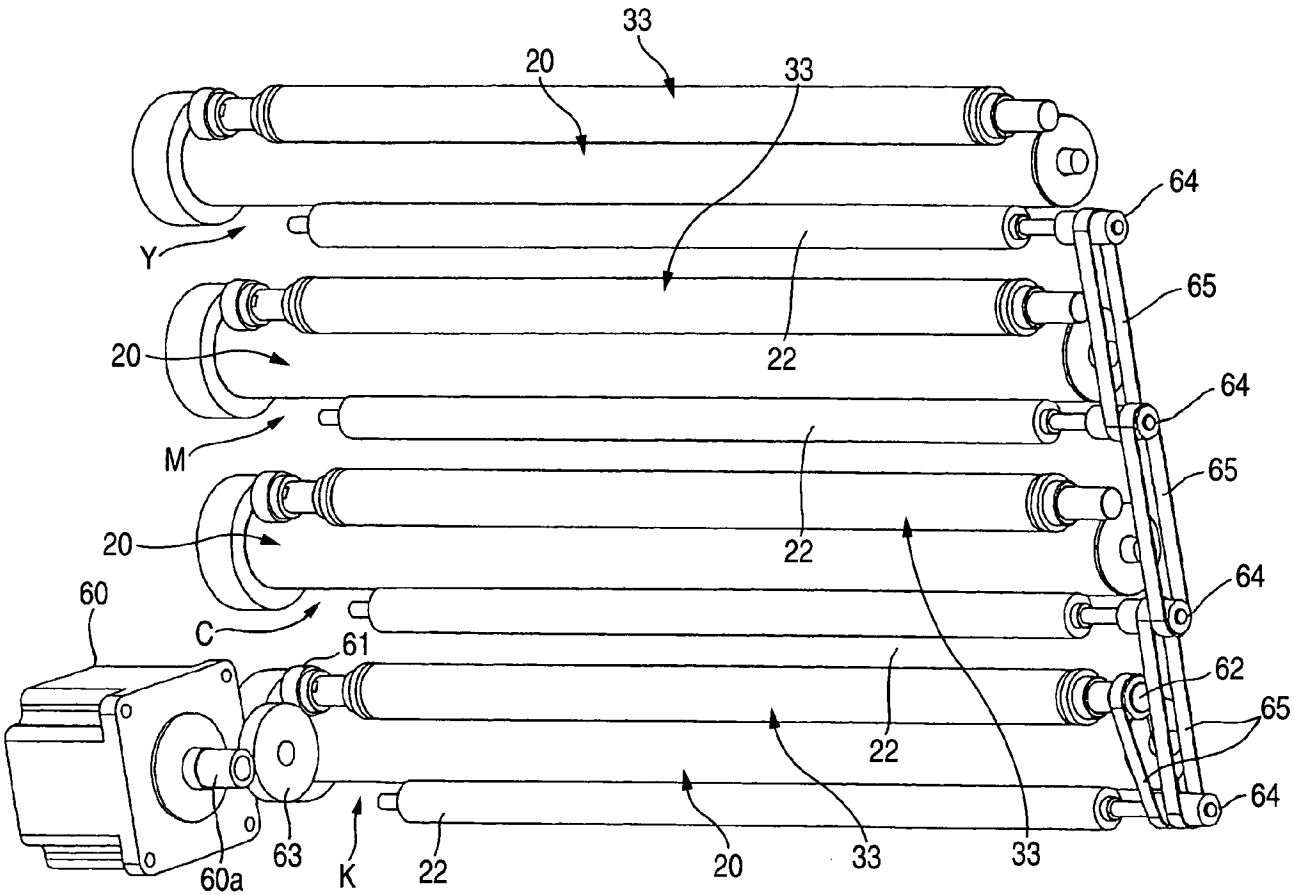
FIG. 11 is a perspective view of a driving system for image carriers and a charging device according to a sixth embodiment of the invention.

In a sixth embodiment of the invention shown in FIG. 11, the developing roller 33 of the image forming station K (black) is driven independently by a driving motor 60 that is different from the driving motor 53 (not shown; described in the first embodiment with reference to FIG. 3) for the image carriers 20. Driving force is transmitted from the developing roller 33 for black to the brush rollers 22 via timing belts 65. The driving system for the image carriers 20 is not shown in FIG. 11 because it is the same as shown in FIG. 3.

A driving gear 61 is connected to one end of the developing roller 33 of the image forming station K (black) and a driving pulley 62 is connected to the other end. The driving gear 61 is in mesh with an output shaft 60*a* of the driving motor 60 via a speed-reducing gear 63.

Follower pulleys 64 are connected to the other ends of the charging device (brush rollers) 22, respectively. A timing belt 65 is stretched between the driving pulley 62 and the follower pulley 64 of the brush roller 22 of the image forming station K, and timing belts 65 are stretched between the brush rollers 22 of the image forming stations K, C, M, and Y.

In this mechanism, the image carriers 20 of the image forming stations Y, M, C, and K are driven sequentially via the gear train. The developing roller 33 of the image forming station K is driven by the other driving motor 60, and the brush rollers 22 are driven by that developing roller 33. In this embodiment, the driving pulley 62 and the follower pulleys 64 are speed-increasing pulleys.

To reduce the size of the image forming stations, it is necessary to make the outer diameters of the developing rollers 33 and the brush rollers 22 smaller than the outer diameter of the image carriers 20. For example, the outer diameters of the developing rollers 33 and the brush rollers 22 are set to similar values of 12 to 18 mm (in this embodiment, 14 mm) for the image carriers 20 whose outer diameter is 30 mm, so that the developing rollers 33 and the brush rollers 22 are driven at circumferential speeds that are relatively close to the circumferential speed of the image carriers 20 (brush rollers 22: two to three times the circumferential speed of the image carriers 2; developing rollers 33: 1.5 to 2.5 times that).

In this embodiment, the driving torque of each brush roller 22 (0.005 to 0.01 N·m) is much smaller than that of each developing roller 33 (0.3 to 0.7 N·m) and hence increase in the load of the motor 60 for driving the developing rollers 33 is small, and the load of the motor 53 for driving the image carriers 20 is not increased. The motive power loss in the entire image forming apparatus can thus be reduced.

Also in this embodiment, the brush rollers 22 can be driven without providing a motor that is dedicated to the driving of the brush rollers 22. In a monochrome printing operation, the brush rollers 22 of the image forming stations C, M, Y having color toners can be driven by driving the developing roller 33 of the image forming station K (black) in link with driving of the image carrier 20 of the image forming station K. This facilitates the rotation on/off control. In a monochrome image forming operation, the brush rollers 22 of the image forming stations C, M, Y having color toners are rotated together with the image carrier 20 of the image forming station K (black), and hence a phenomenon that the portion of each brush roller 22 that is in contact with the image carrier 20 would otherwise be worn locally can be prevented.

This embodiment is free of a phenomenon that rotation-induced vibrations (very minute vibrations) of the brush rollers are directly transmitted to the respective image carriers via the gear trains for driving of the brush rollers, which occurs in the case that the brush rollers are driven by the respective image carriers in the respective image forming stations (e.g., Japanese Patent Publication No. 2000-29278A). Therefore, irregular, minute density unevenness or color misregistration does not occur and hence the image quality can be increased.

Although in the above embodiment the driving motor 60 drives the developing roller 33 of the image forming station K and the brush rollers 22 follow that developing roller 33, an opposite mechanism is possible in which the driving motor 60 drives the brush roller 22 of the image forming station K and the developing rollers 33 follow that brush roller 22. Although in the above embodiment the driving force transmission between the brush rollers 22 and between the developing roller 33 and the brush roller 22 of the image forming station K is performed by belts, it may be performed by gear trains.

Figure 12:
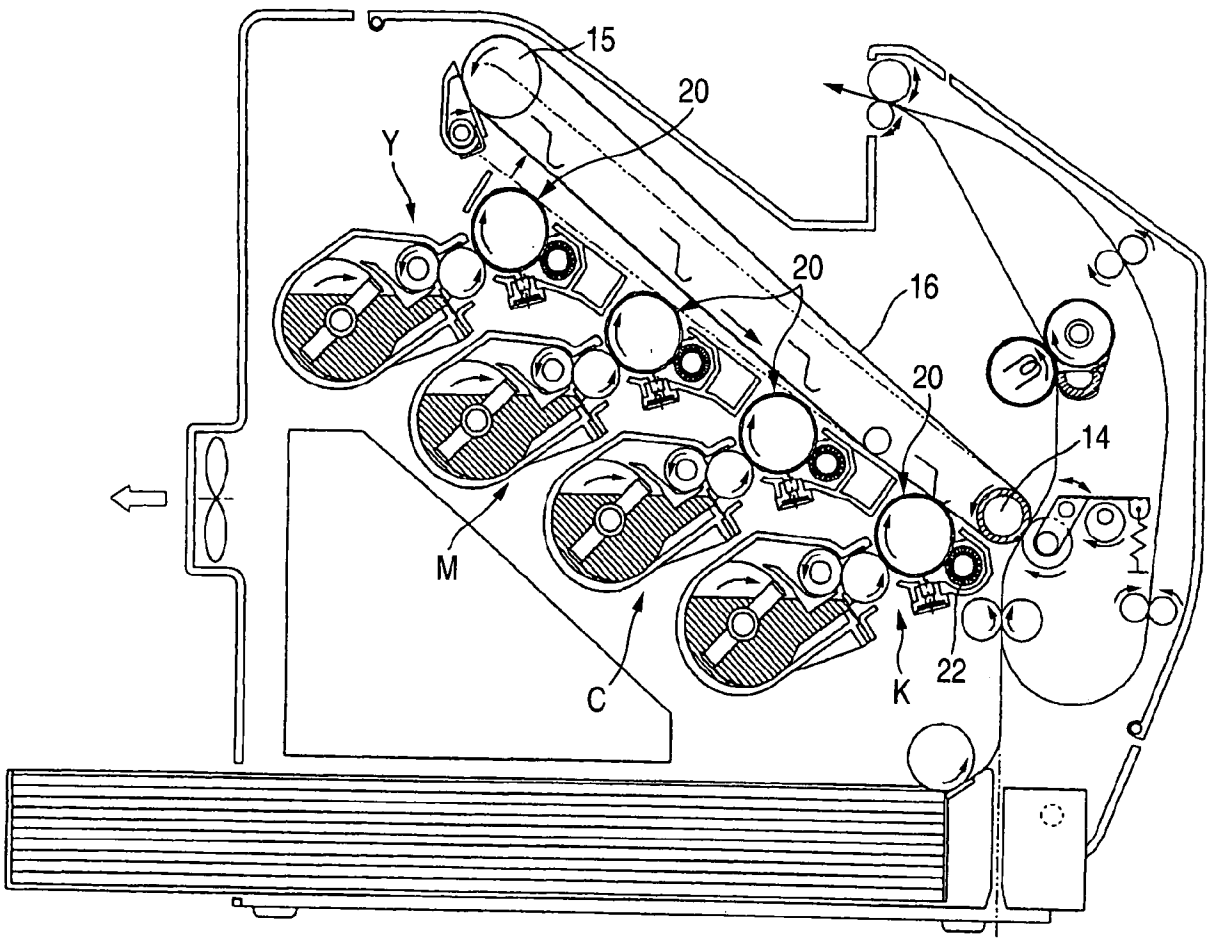
FIG. 12 is a schematic sectional view showing a monochrome printing state of a color image forming apparatus according to a seventh embodiment of the invention.

In a seventh embodiment of the invention shown in FIG. 12, the entire transferring belt 16 is pivotable about the driving roller 14. In a monochrome image forming operation, the transferring belt 16 is moved from the position indicated by a dashed chain line to a position indicated by a solid line, whereby the transferring belt 16 is in contact with the image carrier 20 of the image forming station K for monochrome image formation and is separated from the image carriers 20 of image forming stations C, M, and Y that are not in operation, so that the rotation of the image carriers 20 of the image forming stations C, M, and Y is stopped.

Figure 13:
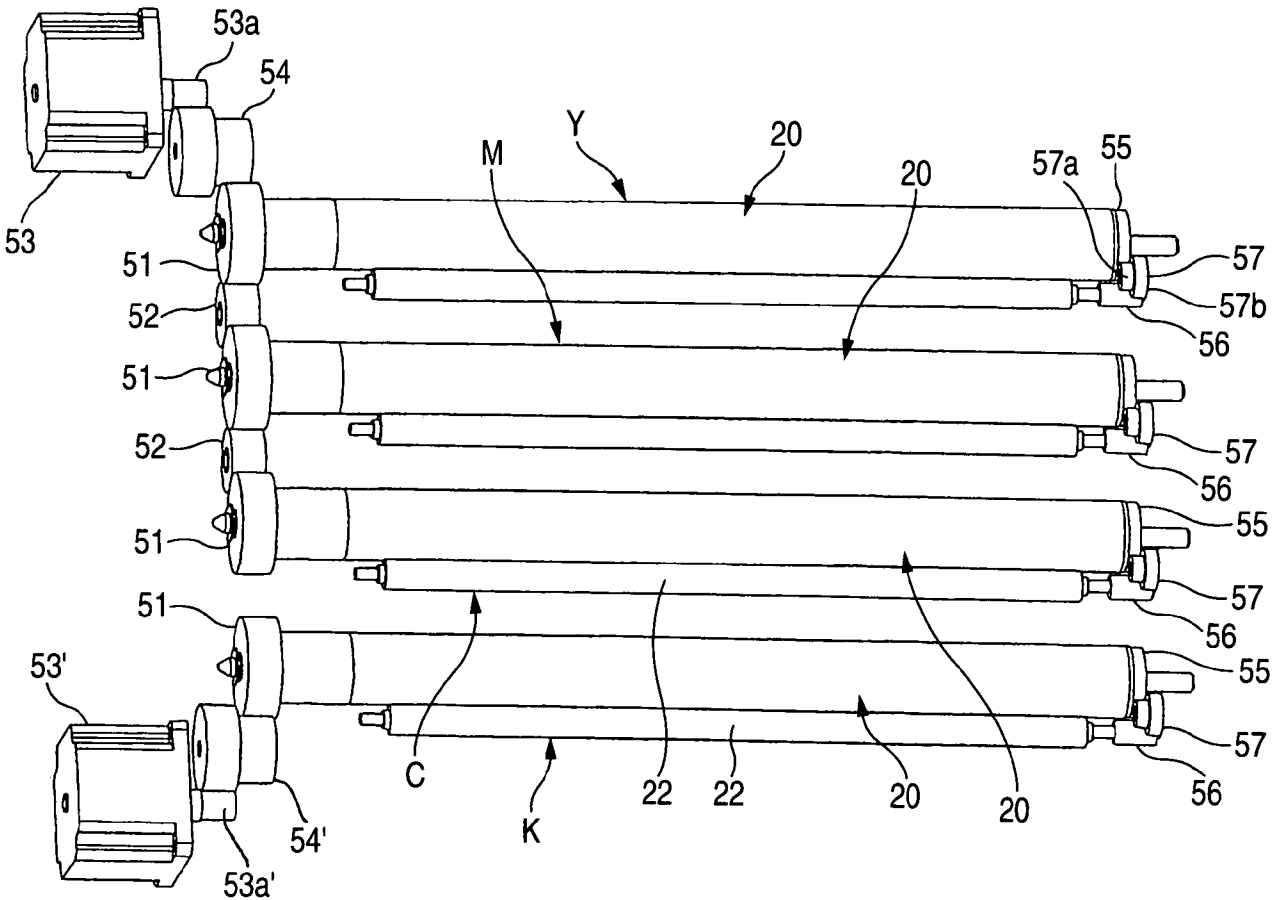
FIG. 13 is a perspective view of a driving system for image carriers and a charging device shown in FIG. 12.

As shown in FIG. 13, driving gears 51 are connected to one ends of the image carriers 20 of the image forming stations Y, M, and C having color toners and a relay gear 52 is in mesh with adjoining ones of the driving gears 51. A first driving motor 53 is disposed in close proximity to the image carrier 20 of the image forming station Y that is closest to the follower roller 15, and an output shaft 53*a* of the first driving motor 53 is in mesh with the driving gear 51 for that image carrier 20 via a speed-reducing gear 54.

A driving gear 55 is connected to the other end of each image carrier 20 and a follower gear 56 is connected to the other end of each charging device (i.e., brush roller) 22. A speed-increasing gear 57 is in mesh with the driving gear 55 and the follower gear 56. The speed-increasing gear 57 is a two-stage gear having a small-diameter portion 57*a* and a large-diameter portion 57*b* that are in mesh with the driving gear 55 and the follower gear 56, respectively. With this mechanism, the image carriers 20 of Y, M, and C are sequentially driven by the first driving motor 53 via the gear train and each small-diameter brush roller 22 is driven by the associated image carrier 20 via the speed-increasing gear train.

On the other hand, an image carrier driving gear 51 is connected to one end of the image carrier 20 of the image forming station K for monochrome image formation. An output shaft 53*a*' of a separate, second driving motor 53' is in mesh with the driving gear 51 via a speed-reducing gear 54'. A driving gear 55 is connected to the other end of the image carrier 20 for monochrome image formation, and a follower gear 56 is connected to the other end of the brush roller 22 of the image forming station K. A speed-increasing gear 57 is in mesh with the driving gear 55 and the follower gear 56.

In the above mechanism, the image carriers 20 of the image forming stations Y, M, and C having color toners are sequentially driven by the first driving motor 53 via the speed-reducing gear 54, the image carrier driving gears 51, and the relay gears 52 that are arranged in line. And the driving force of each image carrier 20 is transmitted to the associated brush roller 22 via the speed-increasing gear 57. Independently of the above driving, the image carrier 20 of the image forming station K for monochrome image formation is driven by the second driving motor 53' via the speed-reducing gear 54' and the image carrier driving gear 51 and the driving force of that image carrier is transmitted to the associated brush roller 22 via the speed-increasing gear 57.

Therefore, the brush rollers 22 can be driven selectively without providing a motor that is dedicated to the driving of the brush rollers 22. The driving of the brush rollers 22 of the image forming stations Y, M, and C having color toners can be stopped in link of a stop of the driving of their image carriers 20. In a monochrome printing operation, the brush rollers 22 of the image forming stations Y, M, and C having color toners are stopped together with their image carriers 20, which prevents wear of those image carriers 20 and brush rollers 22.

Figure 14:
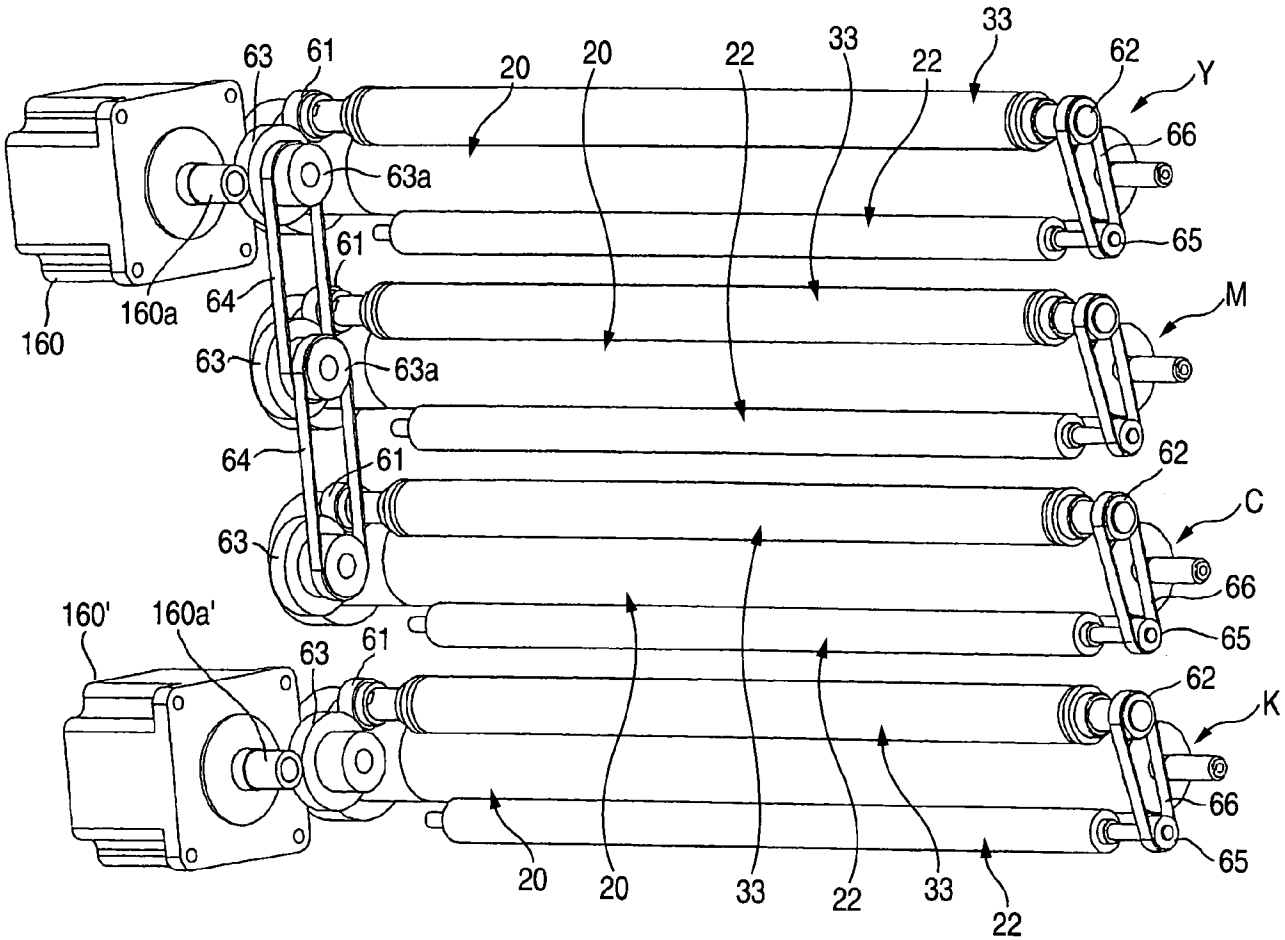
FIG. 14 is a perspective view of a driving system for image carriers and a charging device according to an eighth embodiment of the invention.

In an eighth embodiment of the invention shown in FIG. 14, the developing rollers 33 of the image forming stations Y, M, and C having color toners and the developing roller 33 of the image forming station K for monochrome image formation are driven independently by respective driving motors 160 and 160' that are different from the driving motors 53 and 53' (not shown) for the image carriers 20 that have been described in the seventh embodiment with reference to FIG. 13. Driving force is transmitted from each developing roller 33 to the associated brush roller 22 via a timing belt 66. The driving system for the image carriers 20 is not shown in FIG. 14 because it is the same as shown in FIG. 13.

Driving gears 61 are connected to one ends of the developing rollers 33 of the image forming stations Y, M, and C having color toners, and driving pulleys 62 are connected to the other ends. The driving gear 61 of the image forming station Y is in mesh with an output shaft 160*a* of the first driving motor 160 via a speed-reducing gear 63. A small-diameter transmission pulley 63*a* is integral with the speed-reducing gear 63, and timing belts 64 are stretched between transmission pulleys 63*a*. Follower pulleys 65 are connected to the other ends of the charging device (brush rollers) 22, and timing belts 66 are stretched between the driving pulleys 62 and the follower pulleys 65.

On the other hand, a driving gear 61 is connected to one end of the developing roller 33 of the image forming station K for monochrome image formation and a driving pulley 62 is connected to the other end. The driving gear 61 of the image forming station K is in mesh with an output shaft 160*a*' of the second driving motor 160' via a speed-reducing gear 63. A follower pulley 65 is connected to the other end of the charging device (brush roller) 22, and a timing belt is stretched between the driving pulley 62 and the follower pulley 65. In this embodiment, the driving pulley 62 and the follower pulley 65 of each pair constitute a speed-increasing driving system.

To reduce the size of the image forming stations, it is necessary to make the outer diameters of the developing rollers 33 and the brush rollers 22 smaller than the outer diameter of the image carriers 20. For example, the outer diameters of the developing rollers 33 and the brush rollers 22 are set to similar values of 12 to 18 mm (in this embodiment, 14 mm) for the image carriers 20 whose outer diameter is 30 mm and the developing rollers 33, so that the brush rollers 22 are driven at circumferential speeds that are relatively close to the circumferential speed of the image carriers 20 (brush rollers 22: two to three times the circumferential speed of the image carriers 2; developing rollers 33: 1.5 to 2.5 times that).

In this embodiment, the driving torque of each brush roller 22 (0.005 to 0.01 N·m) is much smaller than that of each developing roller 33 (0.3 to 0.7 N·m). Therefore, the brush rollers 22 can be driven without providing a motor that is dedicated to the driving of the brush rollers 22. The driving of the brush rollers 22 of the image forming stations Y, M, and C having color toners can be stopped in link of a stop of the driving of their image carriers 20. In a monochrome printing operation, the brush rollers 22 of the image forming stations Y, M, and C having color toners are stopped together with their image carriers 20, which prevents wear of those image carriers 20 and brush rollers 22.

In this embodiment, the brush rollers 22 are driven by the driving system for the developing rollers 33 and hence rotation-induced vibrations (very minute vibrations) of the brush rollers 22 of the image forming stations M, C, and K are not directly transmitted to the image carriers 20 via gear trains, respectively. Therefore, irregular, minute density unevenness does not occur and hence the image quality can be increased.

Although in this embodiment the driving motors 160 and 160' drive the developing rollers 33 and the brush rollers 22 follow the developing rollers 33, another mechanism is possible in which the driving motors 160 and 160' drive the brush rollers 22 and the developing rollers 33 follow the brush rollers 22. Although in the above embodiment the driving force transmission between adjoining ones of the developing rollers 33 and between associated ones of the developing rollers 33 and the brush rollers 22 is performed by a belt, it may be performed by a gear train.

Figure 15:
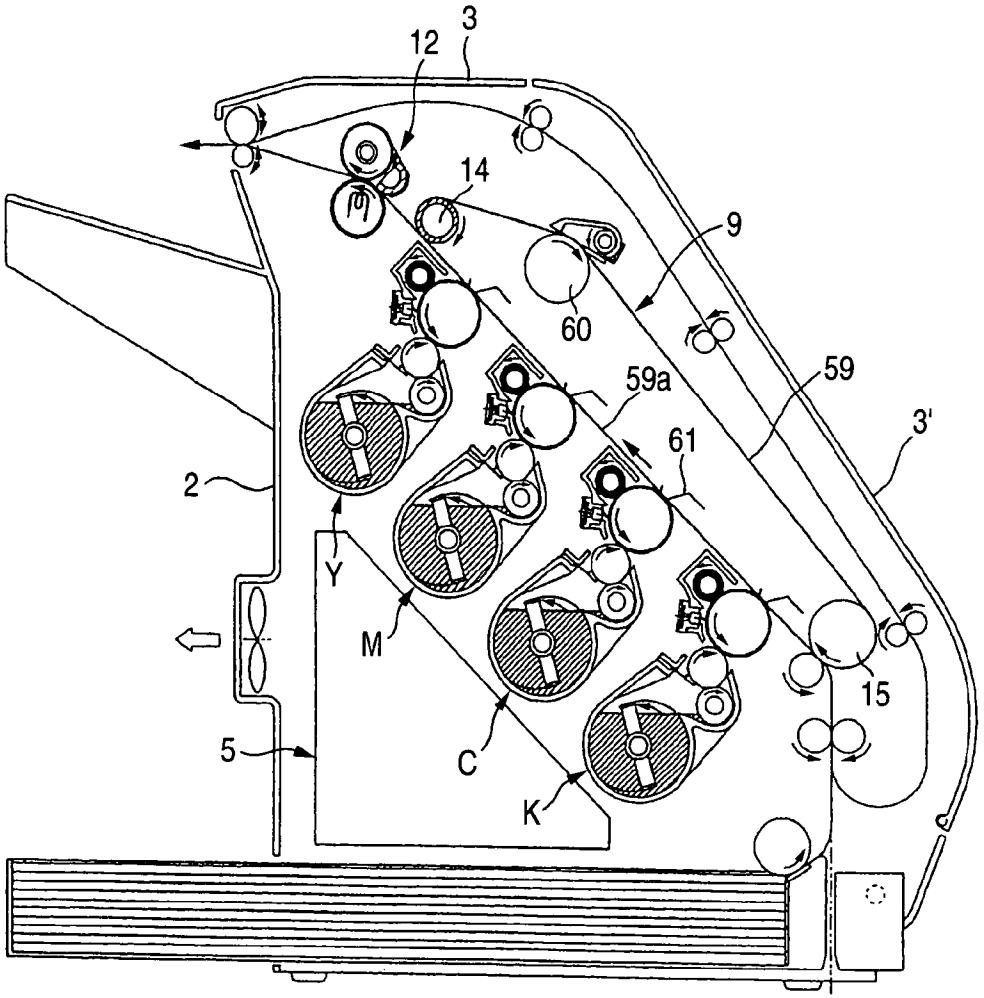
FIG. 15 is a schematic sectional view of a color image forming apparatus according to a ninth embodiment of the invention.

A ninth embodiment of the invention shown in FIG. 15 employs a sheet transporting belt 59 instead of the intermediate transferring belt shown in FIG. 1.

In this embodiment, a transferring belt unit 9 and a fusing unit 12 are disposed inside a first door member 3. The transferring belt unit 9 is equipped with a driving roller 14 that is disposed at an upper position in a housing body 2 and is rotated by a driving source (not shown), a follower roller 15 and a backup roller 60 that are disposed diagonally below the driving roller 14, the sheet transporting belt 59 that is stretched by these three rollers and is driven so as to circulate in the direction indicated by an arrow in FIG. 15, and a cleaner 17 that is opposed to the backup roller 60 and brought in contact with the surface of the sheet transporting belt 59. When the sheet transporting belt 59 is being driven, a tensed portion 59*a* is located below and a slack portion is located above.

Transfer members 61 that are leaf spring electrodes are brought, because of its own elasticity, in contact with the back surface of the sheet transporting belt 59 so as to be opposed to image carriers 20 of image forming stations Y, M, C, and K, respectively. A transfer bias is applied to the transfer members 61. The image carriers 20 of image forming stations Y, M, C, and K are in contact with the tensed portion 59*a* of the sheet transporting belt 59.

Although the embodiments of the invention have been described above, the invention is not limited to those embodiments and various modifications are possible. And a known feature may be substituted or added if necessary.

For example, although in the above embodiments the image carriers 20 are driven sequentially by the single driving motor 53 via the output gear 54, the image carrier driving gears 51, and the relay gears 52 that are arranged in line, motors for driving the respective image carriers 20 may be provided for the respective image carriers 20. The same advantages as described above can be attained by that mechanism.

Although in the above embodiments the driving roller 14 is disposed below the follower roller 15, the driving roller 14 may be disposed above the follower roller 15.

It is noted that in the invention the intermediate transferring belt and the sheet transporting belt are generically referred to as the transferring belt.

What is claimed is:

1. A color image forming apparatus, comprising:

a plurality of image supporters, each of which is operable to support a toner image of one color to be transferred;

a plurality of brush rollers, each of which is brought into contact with an associated one of the image supporters to charge the same; and a plurality of transmitters, each of which is operable to transmit a driving force of an associated one of the image supporters to an associated one of the brush rollers, wherein each of the transmitters comprises a step-up gear.

2. The color image forming apparatus as set forth in claim 1, wherein the image supporters and the brush rollers are rotated in an identical direction.

3. The color image forming apparatus as set forth in claim 1, wherein the toner image is transferred onto a belt member.

4. The color image forming apparatus as set forth in claim 1, wherein the toner image is transferred onto a recording medium carried by a belt member.

5. A color image forming apparatus, comprising:

a plurality of image supporters, each of which is operable to support a latent image of one color to be developed;

a plurality of brush rollers, each of which is brought into contact with an associated one of the image supporters to charge the same;

a plurality of developing rollers, each of which is operable to develop the latent image as a toner image of one color which is to be transferred, on an associated one of the image supporters; and a plurality of transmitters, each of which is operable to transmit a driving force of an associated one of the developing rollers to an associated one of the brush rollers.

6. The color image forming apparatus as set forth in claim 5, wherein the image supporters and the brush rollers are rotated in an identical direction.

7. The color image forming apparatus as set forth in claim 5, wherein the toner image is transferred onto a belt member.

8. The color image forming apparatus as set forth in claim 5, wherein the toner image is transferred onto a recording medium carried by a belt member.

9. A color image forming apparatus, comprising:

a plurality of image supporters, each of which is operable to support a latent image of one color to be developed;

a plurality of brush rollers, each of which is brought into contact with an associated one of the image supporters to charge the same;

a plurality of developing rollers, each of which is operable to develop the latent image as a toner image of one color which is to be transferred, on an associated one of the image supporters; and a transmitter, operable to transmit a driving force of one of the developing rollers to each of the brush rollers.

10. The color image forming apparatus as set forth in claim 9, wherein the image supporters and the brush rollers are rotated in an identical direction.

11. The color image forming apparatus as set forth in claim 9, wherein the toner image is transferred onto a belt member.

12. The color image forming apparatus as set forth in claim 9, wherein the toner image is transferred onto a recording medium carried by a belt member.

13. A color image forming apparatus, comprising:

a plurality of image supporters, each of which is operable to support a toner image of one color to be transferred;

a plurality of brush rollers, each of which is brought into contact with an associated one of the image supporters to charge the same; and a transmitter, operable to transmit a driving force of one of the image supporters to each of the brush rollers.

14. The color image forming apparatus as set forth in claim 13, wherein the one of the image supporters is an image supporter which is associated with a black toner image.

15. The color image forming apparatus as set forth in claim 13, wherein the one of the image supporters is an image supporter which is associated with a yellow toner image.

16. The color image forming apparatus as set forth in claim 13, wherein the image supporters and the brush rollers are rotated in an identical direction.

17. The color image forming apparatus as set forth in claim 13, wherein the toner image is transferred onto a belt member.

18. The color image forming apparatus as set forth in claim 13 wherein the toner image is transferred onto a recording medium carried by a belt member.

19. A color image forming apparatus, comprising:

a plurality of image supporters, each of which is operable to support a toner image of one color to be transferred;

a plurality of brush rollers, each of which is brought into contact with an associated one of the image supporters to charge the same; and a transmitter, operable to transmit a driving force of one of the image supporters to each of the brush rollers; wherein the transmitter comprises a step-up gear.

20. A color image forming apparatus, comprising:

a plurality of image supporters, each of which is operable to support a toner image of one color to be transferred;

a plurality of brush rollers, each of which is brought into contact with an associated one of the image supporters to charge the same; and a driver, operable to rotate every one of the image supporters and every one of the brush rollers in a case where a monochrome image formation is performed, wherein the driver comprises a plurality of transmitters, each of which is operable to transmit a driving force of an associated one of the image supporters to an associated one of the brush rollers, and wherein each of the transmitters comprises a step-up gear.

21. A color image forming apparatus, comprising:

a plurality of image supporters, each of which is operable to support a toner image of one color to be transferred;

a plurality of brush rollers, each of which is brought into contact with an associated one of the image supporters to charge the same; and a driver, operable to rotate every one of the image supporters and every one of the brush rollers in a case where a monochrome image formation is performed, wherein the driver comprises a transmitter, operable to transmit a driving force of one of the image supporters associated with a black toner image to each of the brush rollers.

22. A color image forming apparatus, comprising:

a plurality of image supporters, each of which is operable to support a toner image of one color to be transferred;

a plurality of brush rollers, each of which is brought into contact with an associated one of the image supporters to charge the same; and a driver, operable to rotate every one of the image supporters and every one of the brush rollers in a case where a monochrome image formation is performed, wherein the driver comprises a transmitter, operable to transmit a driving force of one of the image supporters associated with a black toner image to each of the brush rollers; and wherein the transmitter comprises a step-up gear.

23. A color image forming apparatus, comprising:

a plurality of image supporters, each of which is operable to support a latent image of one color to be developed;

a plurality of brush rollers, each of which is brought into contact with an associated one of the image supporters to charge the same;

a plurality of developing rollers, each of which is operable to develop the latent image as a toner image of one color which is to be transferred, on an associated one of the image supporters; and a driver, operable to stop, in a case where a monochrome image formation is performed, ones of the brush rollers which are associated with ones of the image supporters not used for the monochrome image formation, wherein the driver comprises a plurality of transmitters, each of which is operable to transmit a driving force of an associated one of the image supporters to an associated one of the brush rollers, which are not used for the monochrome image formation, and wherein each of the transmitters comprises a step-up gear.

24. A color image forming apparatus, comprising:

a plurality of image supporters, each of which is operable to support a latent image of one color to be developed;

a plurality of brush rollers, each of which is brought into contact with an associated one of the image supporters to charge the same;

a plurality of developing rollers, each of which is operable to develop the latent image as a toner image of one color which is to be transferred, on an associated one of the image supporters; and a driver, operable to stop, in a case where a monochrome image formation is performed, ones of the brush rollers which are associated with ones of the image supporters not used for the monochrome image formation, wherein the driver comprises a plurality of transmitters, each of which is operable to transmit a driving force of an associated one of the developing rollers to an associated one of the brush rollers, which are not used for the monochrome image formation.

25. A color image forming apparatus, comprising:

a plurality of image supporters, each of which is operable to support a latent image of one color to be developed;

a plurality of brush rollers, each of which is brought into contact with an associated one of the image supporters to charge the same;

a plurality of developing rollers, each of which is operable to develop the latent image as a toner image of one color which is to be transferred, on an associated one of the image supporters; and a driver, operable to stop, in a case where a monochrome image formation is performed, ones of the brush rollers which are associated with ones of the image supporters not used for the monochrome image formation, wherein the driver comprises a plurality of transmitters, each of which is operable to transmit a driving force of an associated one of the developing rollers to an associated one of the brush rollers, which are not used for the monochrome image formation, and wherein each of the transmitters comprises a step-up gear.

* * * * *